US005532425A

United States Patent [19]

Nakata et al.

[11] Patent Number: 5,532,425

[45] Date of Patent: Jul. 2, 1996

[54] AUTOMATIC PERFORMANCE DEVICE HAVING A FUNCTION TO OPTIONALLY ADD A PHRASE PERFORMANCE DURING AN AUTOMATIC PERFORMANCE

[75] Inventors: Takuya Nakata; Hiroyuki Iwase; Hiromu Miyamoto, all of Hamamatsu, Japan

[73] Assignee: Yamaha Corporation, Japan

[21] Appl. No.: 203,892

[22] Filed: Mar. 1, 1994

[30] Foreign Application Priority Data

Mar. 2, 1993 [JP] Japan ..... 5-066131
Apr. 23, 1993 [JP] Japan ..... 5-098166

[51] Int. Cl.[6] ..... G10H 1/00; G10H 5/00; G10H 7/00

[52] U.S. Cl. ..... 84/609; 84/649

[58] Field of Search ..... 84/609–614, 634–638, 84/649–652, 666–669

[56] References Cited

U.S. PATENT DOCUMENTS 5,113,744 5/1992 Tanaka et al. ..... 84/634
5,138,925 8/1992 Koguchi et al. ..... 84/609
5,155,286 10/1992 Saito et al. .
5,189,238 2/1993 Hayakawa ..... 84/609

FOREIGN PATENT DOCUMENTS 4-356100 12/1992 Japan .

*Primary Examiner*—Stanley J. Witkowski
*Attorney, Agent, or Firm*—Graham & James

[57] ABSTRACT

Data is set which instructs initiation of a phrase performance at a predetermined timing (beat) during a main automatic performance. When a switch for instructing execution of the phrase performance is operated during the main performance, such a control is performed to cause the phrase performance to start at the predetermined timing. Phrase performance instructing data is also prestored between main performance data. When the phrase performance instructing data is read out during the main performance, phrase performance data is read out from a phrase performance data memory in response to readout of the instructing data, so that the phrase performance is executed.

18 Claims, 13 Drawing Sheets

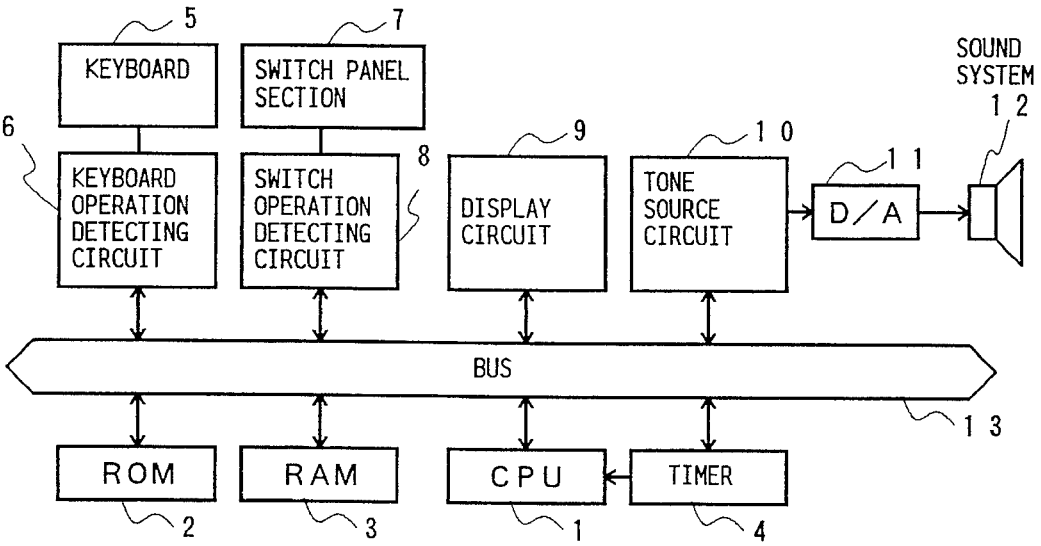
FIG. 1
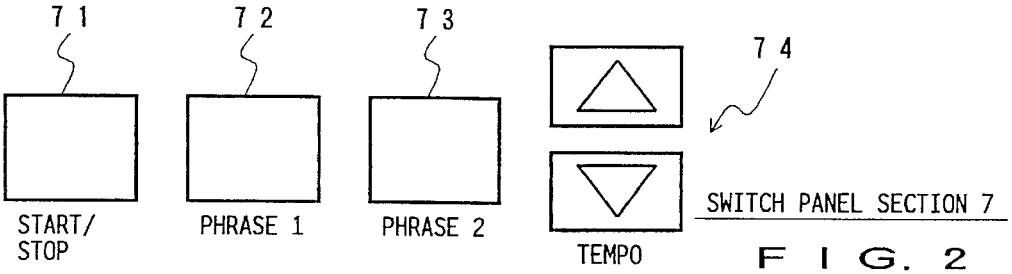
FIG. 2
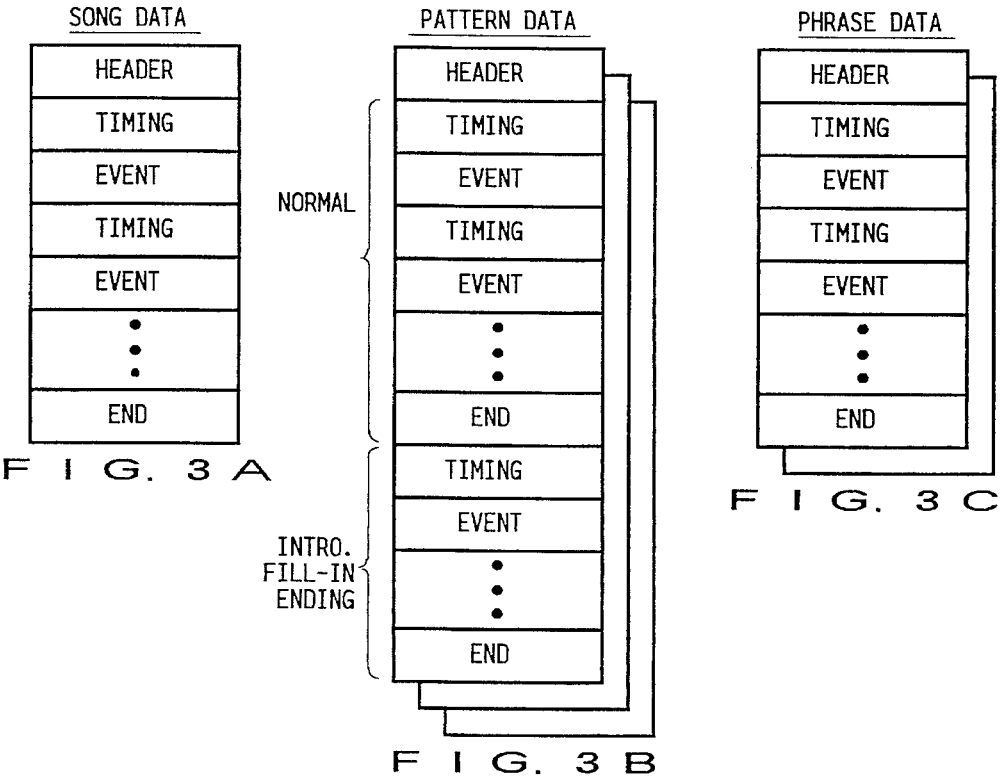
FIG. 3A
FIG. 3B
FIG. 3C

SWITCH PANEL SECTION 21

AUTOMATIC PERFORMANCE DEVICE HAVING A FUNCTION TO OPTIONALLY ADD A PHRASE PERFORMANCE DURING AN AUTOMATIC PERFORMANCE

BACKGROUND OF THE INVENTION

The present invention relates generally to automatic performance devices, and more particularly to automatic performance devices which, during a first automatic performance, allows a second automatic performance to be added in response to operation of a switch or the like.

The present invention further relates to automatic performance devices which is capable of reproducing a phrase by reading out prestored phrase performance data.

Automatic performance devices are known in the art, where an operator enters performance data corresponding to individual musical notes by means of real-time or step recording, and the entered performance data are then reproduced to execute an automatic performance. In addition to such devices, there are known another type of automatic performance devices in which automatic performance data made of short phrases (hereinafter referred to as phrase data) are previously assigned to a plurality of switches, in order to achieve varied automatic performances by reading out the phrase data in response to operation of any of the switches and thereby adding a phrase performance to a normal automatic performance.

For instance, Japanese Patent Laid-open Publication No. HEI 4-356100 that corresponds to U.S. Pat. No. 5,281,756 discloses an automatic performance device which prestores automatic performance data made of predetermined phrases in correspondence to operators or operating members such as switches, and in which the prestored automatic performance data is read out for reproduction instantly in response to operation of any of the operating members. In such an automatic performance device, it is possible to, during a manual performance on a keyboard or the like or an automatic performance (which is different from the above-mentioned automatic phrase performance and will hereinafter be referred to as a first automatic performance), add an automatic performance of predetermined phrases (hereinafter referred to as a second automatic performance) to the first automatic performance.

However, with such prior art automatic performance devices, the beat timings of the second automatic performance often do not properly coincide with those of the first automatic performance. Namely, because as mentioned earlier, the second automatic performance is arranged to get started immediately upon operation of the operating member, the beat timings of the first and second automatic performance will considerably differ from each other unless the user or player operates the operating member to the beat timings of the first performance. But, it is not at all easy for the player to make his or her operation timings of the operating member exactly coincident with the first performance beat timings.

Further with the prior art automatic performance devices, a phrase performance is achieved only by the player's real-time operation of the operating member, so that there arises a problem that a same automatic performance with a phrase performance added thereto can be executed only once but can never be repeated.

U.S. Pat. No. 5.155,286 also discloses that automatic performance is executed by repetitively reading out prestored motif performance data while a predetermined tone-generation instructing switch is operated. However, the U.S. Patent fails to disclose a technique of assigning a selected one of plural performance data to an operating member and recording operation data indicative of operation of the operating member, nor does it disclose a technique of starting a motif performance at a predetermined timing (beat) after operation of the operating member.

SUMMARY OF THE INVENTION

It is therefore an object of the present invention to provide an automatic performance device capable of executing a first automatic performance with a second automatic performance added thereto which allows beat timings of the second automatic performance to not differ from those of the first automatic performance even when instruction to start the second automatic performance is given at a timing somewhat different from the first automatic performance.

It is another object of the present invention to provided an automatic performance device which is capable of recording phrase performance data between automatic performance data so as to reproduce the phrase performance data along with the automatic performance data.

In order to achieve the above-mentioned object, an automatic performance device in accordance with the present invention comprises a first section for executing a first automatic performance, a second section for performing a second automatic performance, an instruction section for instructing execution of the second automatic performance, a timing setting section for setting a predetermined timing at which the second automatic performance is to start during the first automatic performance, and a performance control section for, in response to instruction given by the instruction section during the first automatic performance, causing the second automatic performance to start at the timing set by the setting section.

With such an arrangement, when instruction to initiate execution of the second automatic performance is given during the first automatic performance, the second automatic performance is caused to start at a predetermined timing of the first automatic performance, in such a manner that the second automatic performance (phrase performance) can be inserted in synchronism with progression of the first automatic performance.

In order to achieve the other object, an automatic performance device in accordance with the present invention comprises a first storage section comprising read/write storage for storing first automatic performance data, a second storage section storing a plurality of second automatic performance data, an operator section including an operator to which is assigned any of identification data identifying ones of the second automatic performance data, a recording control section for, in response to operation of said operator, recording into said first storage section operation data indicative of the operation of said operator and the and the identification data assigned to said operator as a part of said first automatic performance data, a read-out control section for reading out the first automatic performance data from said first storage section and for, if the operation data and the identification data are contained in the read-out first automatic performance data, reading out from said second storage section the second automatic performance data corresponding to the identification data, and a tone generating section for generating a tone signal on the basis of the first and second automatic performance read out by said read-out control section.

With such an arrangement, when the operator is operated, the identification data identifying the second automatic performance data assigned to the operator and the operation data are recorded as part of the first automatic performance data. For reproduction, the first automatic performance data is read out from the first storage section by the read-out control section, on the basis of which a tone signal is generated by the tone generating section. For a timing when the operation data and identification data are contained in the read-out second automatic performance data, the second automatic performance data corresponding to the identification data is read out from the second storage means. Thus, a desired phrase performance can be selected from among the plurality of the second automatic performance data and can be added in a desired time portion of a main automatic performance (the first automatic performance data) for recording and subsequent reproduction.

In order to achieve the other object, an automatic performance device in accordance with the present invention comprises a first storage section storing first automatic performance data, said first automatic performance data including instruction data, a second storage section for storing a plurality of second automatic performance data, said instruction data instructing performance of any of said second automatic performance data, an operator section including an operator to which is assigned any of said second automatic performance data, a first read-out control section for reading out the first automatic performance data, second read-out control section for reading out, from said second storage section, the second automatic performance data instructed by said instruction data in the first automatic performance data read out by said first read-out control section, and the second automatic performance data that is assigned to said operator in response to operation of said operator, and a tone generating section for generating a tone signal on the basis of the first and second automatic performance data read out by said first and second read-out control section.

With such an arrangement, it is possible to freely reproduce either of a predetermined phrase performance (second automatic performance) arranged in a main automatic performance (first automatic performance) and an optional phrase performance (second automatic performance) corresponding to real-time operation of the operator.

Now, the preferred embodiments of the present invention will be described in detail with reference to the accompanying drawings.

BRIEF DESCRIPTION OF THE DRAWINGS

In the accompanying drawings:

FIG. 1 is a block diagram illustrating the general hardware structure of an automatic performance device in accordance with an embodiment of the present invention;

FIG. 2 is a diagram showing by way of example the principal portion of a switch panel section shown in FIG. 1;

FIGS. 3A to 3C show examples of storage formats of automatic performance data, FIG. 3A showing a storage format of song data, FIG. 3B showing that of pattern data, FIG. 3C showing that of phrase data;

DETAILED DESCRIPTION OF THE PREFERRED EMBODIMENTS

Figure 4A:
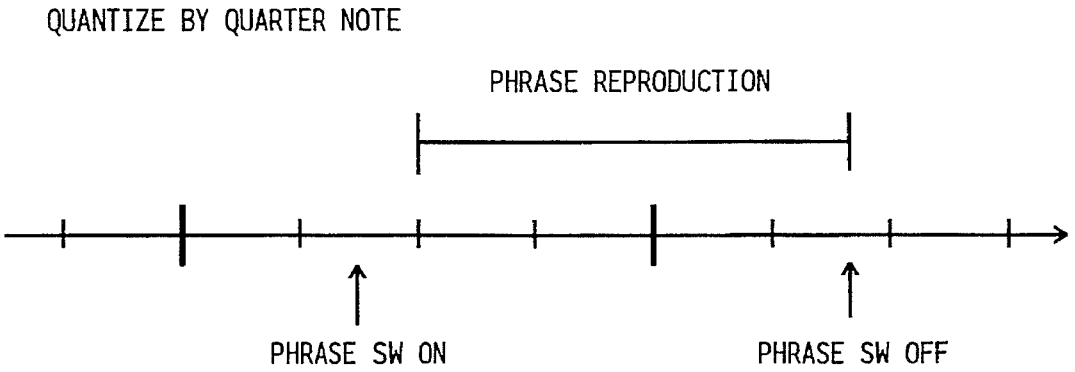
FIG. 4A shows by way of example a corresponding relationship between switch operations and an automatic performance which is achieved in the embodiment of the present invention.

Referring first to FIG. 1, a central processing unit (hereinafter referred to as a CPU) 1, which controls operations of an automatic performance device in accordance with an embodiment of the present invention, is connected with various operation sections via a bus 13 to carry out, various processing in accordance with control programs stored in a ROM 2. A RAM 3 has functions as a group of working registers for temporarily storing data to be used in the processing and also as a data memory section for storing automatic performance data.

A timer 4 is provided for supplying the CPU 1 with interrupt signals at predetermined time intervals in such a manner that an automatic performance tempo is determined by the frequency of the interrupt signals. A keyboard 5 has a plurality of keys, whose operational states are detected by a keyboard operation detecting circuit 6.

A switch panel section 7 has a plurality of switches provided thereon, principal ones of which are shown in FIG. 2. A switch 71 is provided for instructing start/stop of an automatic performance of song that is a first form of the automatic performance achieved by the embodiment. Depressing this start/stop switch 71 when the device in the automatic performance mode causes an automatic song performance to start, and depressing the start/stop switch 71 when the device i s not in the automatic performance mode causes an automatic song performance to stop. Switches 72 and 73 are provided for instructing an automatic performance of phrase that is second form of the automatic performance achieved by the embodiment. While the switch 72 or 73 is depressed, a first phrase (hereinafter referred to as phrase 1) or a second phrase (hereinafter referred to as phrase 2) is automatically performed. A switch 74 is a tempo changing switch 74 that is operated to make an automatic tempo faster or slower. Operations or depressions of these switches are detected by a switch operation detecting circuit 8.

A display circuit 9 displays various states of the automatic performance device etc. A tone source circuit 10 which may comprise a well-known tone source system such as the one using a waveform memory, receives performance data resultant from manual operation on the keyboard 5 and automatic performance data, so as to generate corresponding tone signals in digital format. Output tone signals from the tone source circuit 10 are then converted by a D/A (Digital-to-Analog) converter into analog signals and then audibly reproduced or sounded via a sound system 12 comprising an amplifier and a loud speaker.

FIGS. 3A to 3C show by way of example data formats of automatic performance data. In this embodiment of the invention, each piece of music (i.e., song) is performed in such a manner that plural patterns stored in advance are read out for reproduction in accordance with a previously-programmed performance sequence. Each of the patterns is composed of performance data having a total data length to cover one to several measures and contains patterns for plural different sections (such as normal pattern, intro. pattern, fill-in pattern and ending pattern). In addition, each of the patterns contains a plurality of performance parts (such as chord-backing part, bass part, drum part etc.).

FIG. 3A illustrates the contents of song data. The lead of the song data is a header region, in which are stored various setting data on initial tone color, initial tempo, initial pattern, initial section, initial chord etc. for an automatic song performance. The header is followed by performance data which is composed of event data and timing data indicative of an event occurrence timing. In the embodiment, pattern event indicative of a pattern change, section event indicative of a section change, chord event indicative of a chord change, etc. are stored as the event data. As the timing data, such data is stored which expresses an occurrence interval between the event data in terms of the number of clock pulses (duration data). End data is stored at the end of the song data.

FIG. 3B illustrates the contents of pattern data. A header region is present in the lead of the pattern data, in which are stored the number of measures, beat, start address, etc. of each section of the pattern. The header is followed by performance data which is composed of event data and timing data. The event data includes, for example, note event data indicative of note-on or note-off, tone pitch and tone intensity, and pitch bend data indicative of a pitch change. As with the song data, the timing data is duration data indicative of an occurrence interval between the event data. End data is stored at the end of each section.

Further. FIG. 3C illustrates the contents of phrase data. A header region is present in the lead of the phrase data, in which are stored quantization data defining a reproduction start timing of a phrase (i.e., data indicating at which timing a performance is to start when executing a phrase performance during a song reproduction), and setting data on initial tone color. etc. for a phrase performance. The header is followed by phrase performance data which is, as with the above-mentioned song and pattern data, composed of event data and timing data. The event data includes, for example, note event data, tone color change data and pitch bend data. The timing data is indicative of an occurrence interval between the event data. End data is stored at the end of the performance data.

Figure 4B:
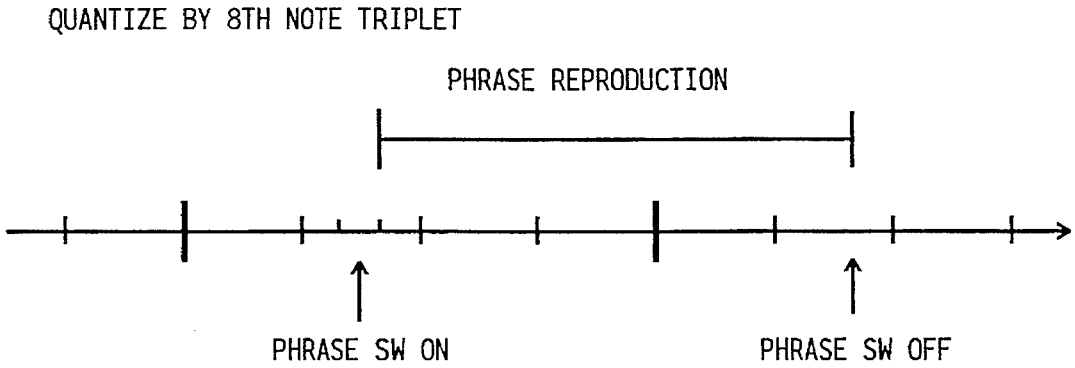
FIG. 4B is a view similar to FIG. 4A, showing another example of the relationship between switch operations and an automatic performance.

FIGS. 4A and 4B show a relationship between the operational states of the phrase switch and the phrase performance state. FIG. 4A typically shows a case where the value of quantization data stored in the header region of the phrase data corresponds to a quarter note, while FIG. 4B shows a case where the value of quantization data corresponds to an eighth-note triplet.

In the case shown in FIG. 4A, when the phrase switch 72 or 73 is depressed or operated during an automatic song performance to select phrase 1 or 2, performance of the selected phrase will not start before a first quarter-note timing of the automatic song performance after the switch depression is reached. Upon arrival of such a quarter-note timing, the phrase performance starts and continues until the depressed phrase switch 72 or 73 is released or turned off. The phrase performance is caused to stop the moment the phrase switch 72 or 73 is released.

Similarly, in the case shown in FIG. 4B, when the phrase switch 72 or 73 is depressed during an automatic song performance to select phrase 1 or performance of the selected phrase will not start before a first eighth-note triplet timing of the automatic song performance after the switch depression is reached. Upon arrival of such a timing, the phrase performance starts and continues until the switch 72 or 73 is released or turned off.

With the basis of quarter note=24, the quantization data may be set at any optimum value depending upon the contents of the stored phrase performance data. For instance, a normal four-beat or eight-beat phrase performance can be properly synchronized with a song performance if the quantization data is set at a value corresponding to a quarter note (i.e., "24") or to an eighth note (i.e., "12"). Further, in the case of a triplet-type-phrase performance, the performance can be started in a relatively short time without getting out of synchronism with a song performance, if the quantization data is set at a value corresponding to a triplet. The quantization data can also be set at "0" so that the phrase performance starts the very moment the phrase switch 72 or 73 is depressed. If data have been prestored such that a cymbal sound and a drum sound are simultaneously sounded in a phrase performance, it is possible to insert percussive sounds as a form of sound effect by operating the phrase switch. In such a case, since the phrase performance stops immediately, it is not necessary to care about synchronization with the timing of a song performance and thus the quantization data may be set at "0".

Now, with reference to flowcharts shown in FIGS. 5 to 8, description will be made below on processing which is carried out by the CPU 1 for performing various functions of the automatic performance device in accordance with the embodiment.

Figure 5:
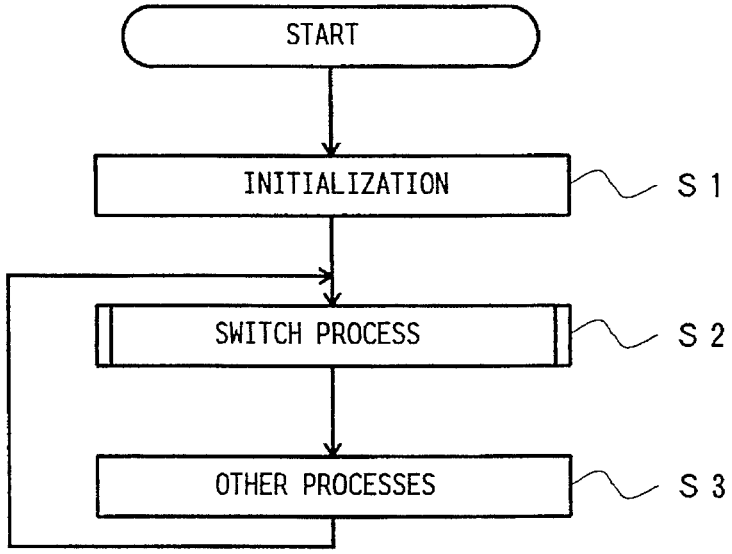
FIG. 5 is a flowchart of an example of a main routine carried out by a CPU shown in FIG. 1.

FIG. 5 shows a main routine, in which upon switching-on of an unillustrated power source switch, the CPU 1 initiates its processing in accordance with the programs stored in the ROM 2. First, step S1 initializes various registers provided in the RAM 3. For instance, in this initialization step S1, a run flag RUN, wait flags WAIT1 and WAIT2, and switch-on flags SWON1 and SWON2 are all reset to "0", and the setting data stored in the respective header regions of the song, pattern and phrase data are read out to provide various necessary settings.

Figure 8:
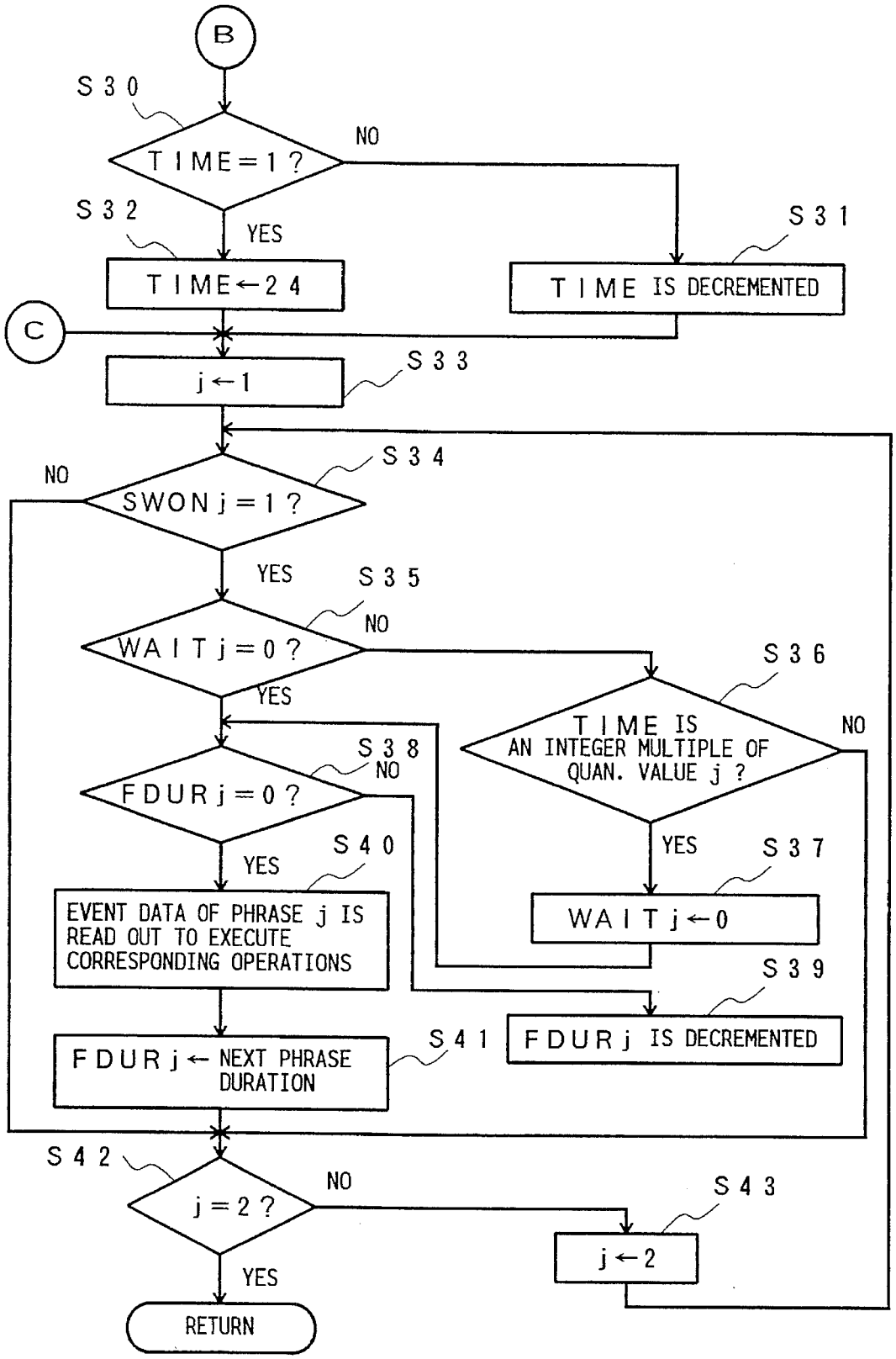
FIG. 8 is a flowchart illustrating the remaining part of the timer interrupt process.
Figure 9:
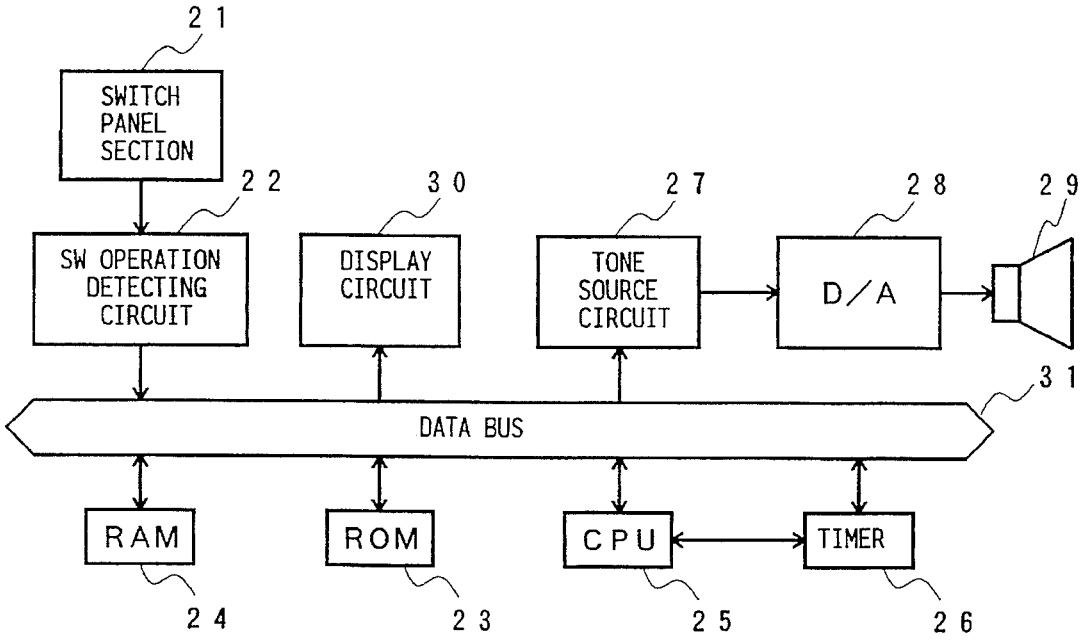
FIG. 9 is a block diagram illustrating the general hardware structure of an automatic performance device in accordance with another embodiment of the present invention.

Then, the main routine goes to step S2 to perform a switch process, detail of which will be described later. After step S2, the routine goes to step S3 to perform other processes such as processes for the keyboard and display, and then loops back to step S2 for repetitively performing steps S2 and S3. Other than these processes, a timer interrupt process, which will be later described in connection with FIGS. 8 and 9, is carried out at a frequency as determined by a selected tempo (for example, 24 times per quarter note).

Figure 6:
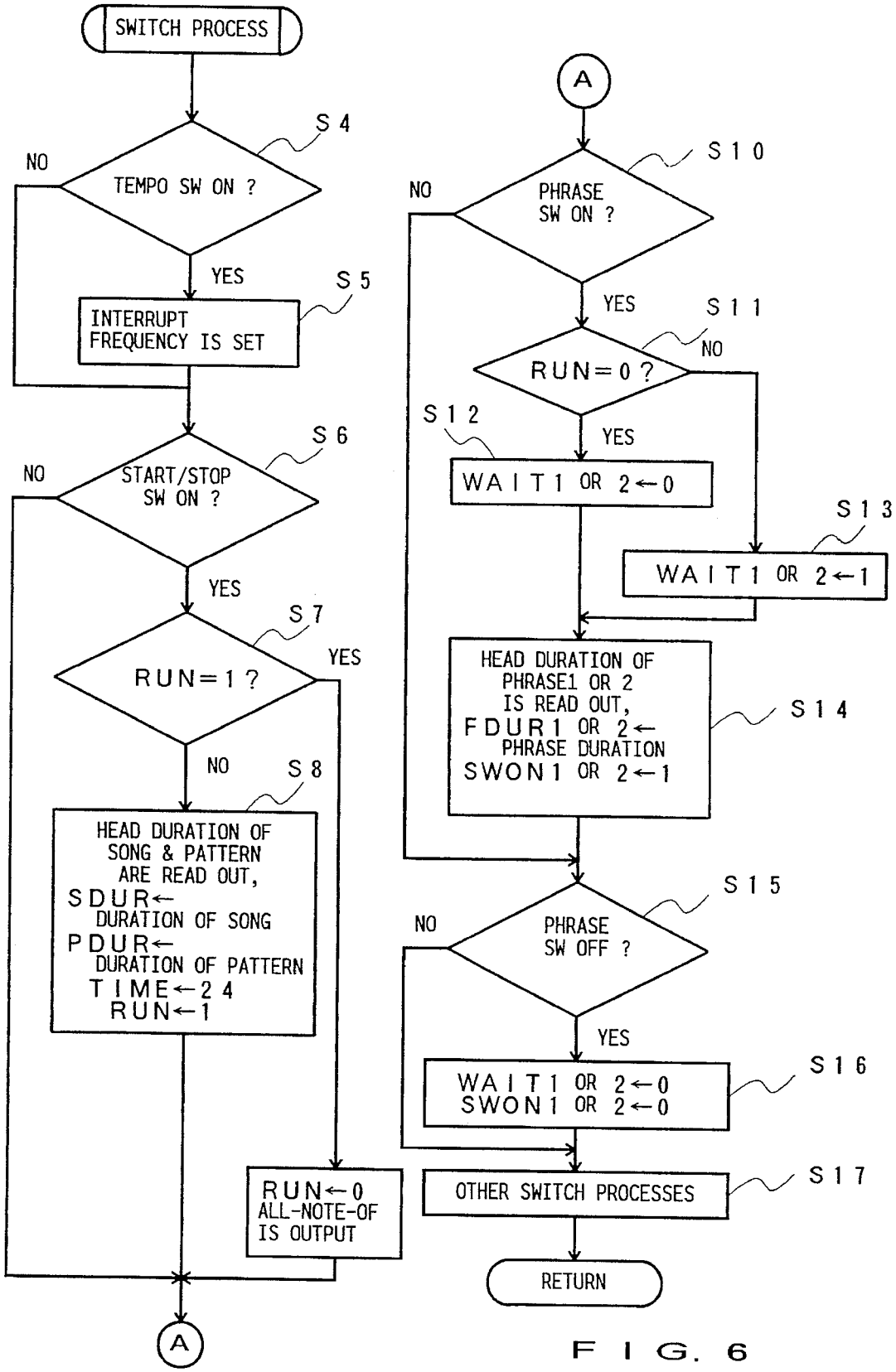
FIG. 6 flowchart illustrating an example of a switch process shown in FIG. 5.

FIG. 6 is a flowchart illustrating the detail of the switch process in step S2. Once turning-on or depression of one of tempo switches (FIG. 2) has been detected in step S4, the program goes to step S5, where the frequency of interrupt signals generation by the timer 4 is set at a value corresponding to a selected tempo. When the tempo-up switch has been depressed, the interrupt frequency is set to be higher, and when a tempo-down switch has been depressed, the interrupt frequency is set to be lower. Thereafter, or if there is detected no depression of the tempo switches, the program goes to step S6. Step S6 determines whether or not the song start/stop switch 71 has been turned on. With the affirmative determination in step S6, the program goes to step S7 to further determine whether the run flag RUN is "1" If the run flag RUN is not at "1", the program goes to step S8, where, in order to start an automatic performance , the duration data in the respective leads of the song and pattern data are read out and loaded into song duration register SDUR and pattern duration register PDUR, respectively. Then, a value "24" is stored into time register TIME. The thus-stored value in the time register TIME is used for timing synchronization in starting a phrase performance during progression of an automatic performance, and on the basis of this value, it is determined at which timing the automatic performance is currently located. With the timer interrupt process to be later described, the value in the time register TIME is varied from 24 to 23, . . . 1, 24, 23, . . . and so on. In addition, the run flag RUN is set at "1".

If the determination in step S7 is that the run flag RUN is at "1", the program goes to step S9, where the flag RUN is reset to "0" so as to stop the automatic performance and all-note-off command is output to the tone source circuit 10 so as to extinguish any sounds having been sounded till then. Thereafter, or if a NO determination has been made in step S6, the program goes to step S10.

If it is determined in step S10 that the phrase switch 72 or 73 has been turned on, the program goes to step S11 and then to step S12 or S13 depending upon the current value of the run flag RUN; i.e., the program goes to step S12 to set the wait flag WAIT1 or WAIT2 at "0" if the flag RUN is at "0", but it goes to step S13 to set the wait flag WAIT1 or WAIT2 at "1" if the flag RUN is at "1" The wait flags WAIT1 and WAIT2, which correspond to phrase 1 and phrase 2, respectively, indicate whether or not it is necessary to wait, after the depression of the phrase switch 72 or 73, to start a phrase performance till arrival of the timing dictated by the quantization data; i.e., if the flag RUN is at "0", the phrase performance is caused to start immediately, but if "1", initiation of the phrase performance is delayed till arrival of the quantization data timing. If the run flag RUN is at "0", it is not at all necessary to delay initiation of the phrase performance, and thus the wait flag WAIT1 or WAIT2 is set at "0" so that the phrase performance may be initiated immediately.

After that, the program goes to step S14, where the duration data of selected phrase 1 or 2 is read out and loaded into the corresponding phrase duration register FDUR1 or FDUR2. Then, the corresponding switch-on flag SWON1 or SWON2 is set at "1". Each of the switch-on flags SWON1 and SWON2 is such a flag that is set at "1" while the corresponding phrase switch is depressed. After that, if a NO determination is obtained in step S10, the program goes to step S15.

If it is detected in step S15 that the phrase switch 72 or 73 has been turned off, the program proceeds to step S16 clear the flags WAIT1 or WAIT2 and SWON1 or SWON2 to "0" and then goes to step S17. Even when step S15 does not detect turning-off of the phrase switch, the program jumps to step S17 without taking step ST16. In step S17, switch processes other than illustrated are performed, after which the program returns to the main routine shown in FIG. 5.

Figure 7:
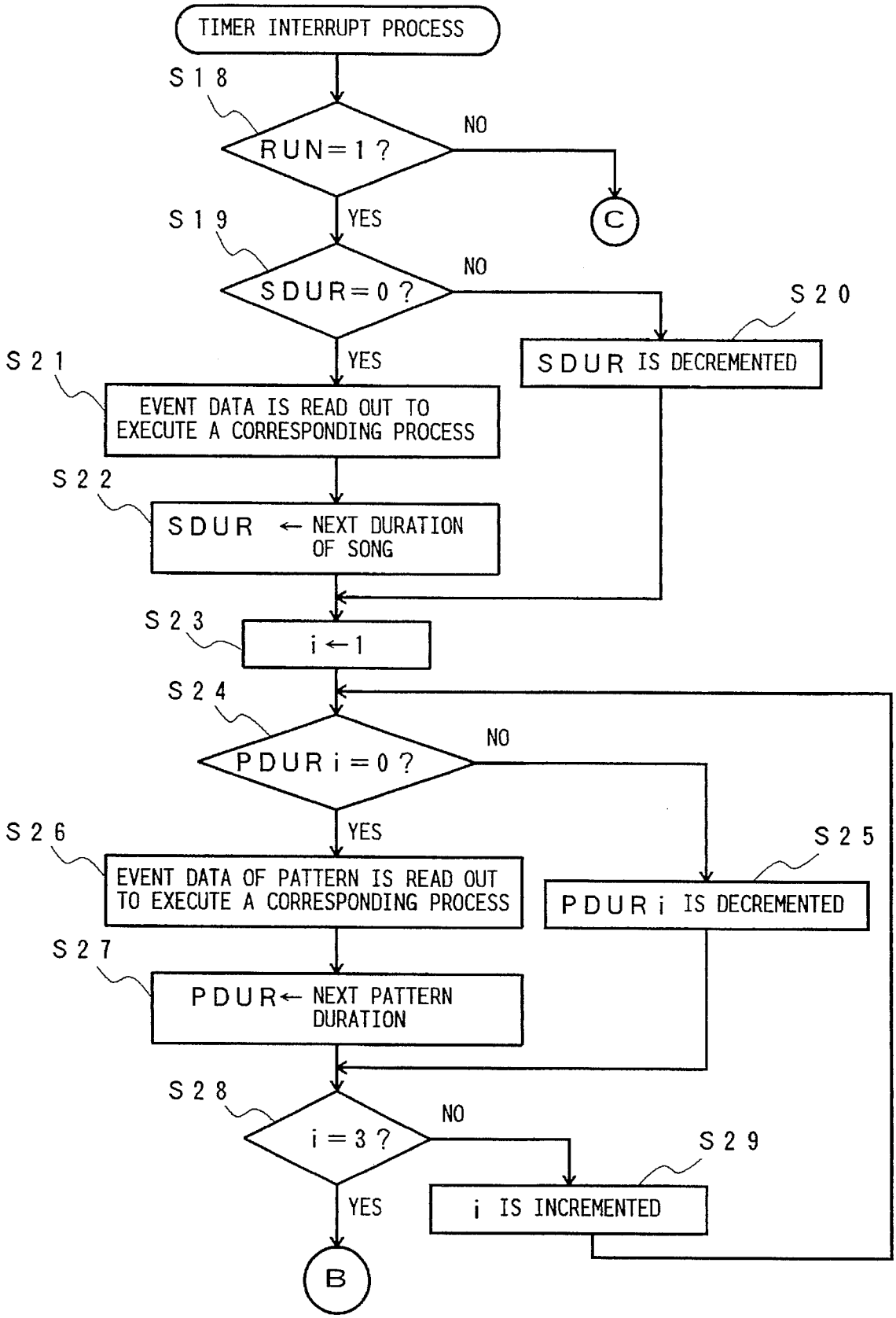
FIG. 7 is a flowchart illustrating a part of an example of a timer interrupt process.

FIGS. 7 and 8 show a flowchart of the timer interrupt process that is carried out at a rate of 24 times per quarter note. Each time a timer interrupt signal is received from the timer 4, the CPU 1 interrupts its execution of the main routine to carry out the timer interrupt process. First, in step S18, it is determined whether the run flag RUN is at "1" If the answer is "1", i.e., if an automatic performance in progress, the program goes to step S19; however, if the answer is "0", i.e., if an automatic performance not in progress, the program goes to step S33. In step S19, a further determination is made as to whether the value of the song duration register SDUR is "0" If the determination is "0" in step S19, it means that the current timing is an event data readout timing, so the program goes to step S21 so as to read out event data of a song and execute a process corresponding to the read-out event data.

If the read-out event data is pattern event data, a change in pattern to be read out is instructed, if the event data is section event data, a change in section to be read out is instructed, and similarly, if the event data is chord event data, a change is made in designation of chord to be used for modifying note data of the chord backing and bass parts within a pattern, as will be later described in detail. If, on the other hand, end data is read out, processes such as for resetting the run flag RUN to "0" are executed in order to stop the automatic performance. Then, the program goes to step S22 to store next duration data into the song duration register SDUR.

If, on the other hand, the determination in step S19 is in the negative, it means that an event data readout timing has not yet arrived, and thus the program goes to step S20 to decrement the value in the song duration register SDUR and then goes to step S23.

In step S23, variable i representative of the part of pattern data to be processed is set at "1". The variable i will take one of values from 1 to 3 which correspond to the chord backing, bass and drum parts. After that, the program goes to step S24, where a determination is made as to whether the value in pattern duration register PDURi is "0". If the value is "0", step S26 is taken in order to read out pattern data. More specifically, in this step S26, event data of the pattern is read out to execute a corresponding process. If the pattern of the event data read out is of the chord backing or bass part and if the read-out event data is note-on data, then note number data indicative of a given tone pitch is modified in accordance with a then-designated chord and the thus-modified note event data is provided to the tone source circuit. Thus, a tone will be sounded. In the event end data is read out, the program reverts to and reads out the leading data of the pattern. After step S26, the program goes to step S27 to load next pattern duration data into the pattern duration register PDURi.

If the determination in step S24 is in the negative, step S25 is taken to decrement the value in the register PDURi.

During the readout of these pattern data, such data are read out which correspond to the pattern and section designated and modified by the song data. After step S27 or step S25, the program goes to step S30 to determine whether the variable i is "3". The program goes to step S30 if the variable i is "3", otherwise it goes to step S29. In step S29, the variable i is incremented. Namely, step S30 is taken once the operations of steps S24 to S27 have been executed three times.

In step S30, if the value in the time register TIME is "1", step S32 is taken to set register TIME at "24", but if not, the program branches to step S31 to decrement the value in the register TIME. This causes the register TIME to repeat sequential storage of values 24, 23, . . . , 1, 24, 23, and so on. After that, the program goes to step S33.

In step S33, variable j representative of phrase 1 or 2 is set at "1". Then, step S34 is taken to determine whether the switch-on flag SWONj is at "1". If answered in the affirmative in step S34, it means that the phrase switch is being depressed, and thus the program goes to step S35 to initiate operations for reading out the phrase data. In step S35, it is determined whether the wait flag WAITj is at "0". The flag WAITj at "0" means that a phrase performance is not waiting to start (not in the start-waiting state), and so the program goes to step S38, which will be described below. The flag WAITj at "1"means that a phrase performance is in the start-waiting state, and so the program goes to step S36 to check to see whether the value in the register TIME is an integer multiple of a preestablished quantization value j. If answered in the affirmative in step S36, it means that a phrase start timing has arrived, the program resets the wait flag WAITj to "0" in step S37 and then goes to step S38. If it is determined in step S36 that the value in the register TIME is an integer multiple of the quantization value j, the program jumps to step S42. Because of the operation in steps S30 to S32 as mentioned, a phrase performance will not start before the value in the register TIME becomes an integer multiple of the quantization value j.

In step S38, whether the value stored in the phrase duration register FDURj is "0" is determined. If the value is "0", it means that an event readout timing has been reached, and so event data of the phrase j is read out to execute corresponding operations. Namely, if the read-out event data is note-on event data, the pitch-indicative note number is modified on the basis of the then-designated chord and the modified note event data is provided to the tone source circuit 10. If end data is read out, the program reverts to the lead of the phrase data as mentioned previously.

Thereafter, the program goes to step S41 to load the duration of a next phrase into the phrase duration register FDURj and then goes to step S42. If, on the other hand, a determination of NO is obtained in step S38, it means that an event readout timing has not been reached, and so the program branches to step S39 in order to decrement the value in the register FDURj and then moves to step S42. Step S42 checks to see whether the variable j is "2". The program returns to the main routine of FIG. 5 if the variable j is "2". Otherwise, the program loops back to step S34 after having changed the variable j to "2"; i.e., it returns to the main routine only after operations from steps S34 to S42 have been done twice.

According to the embodiment as described above, once the phrase switch 72 or 73 is depressed to select phrase 1 or 2 during an automatic song performance, an automatic phrase performance can be added to the song performance with the start timing of the phrase performance properly controlled in accordance with the quantization data. It is to be note here that when the phrase switches 72 and 73 are both depressed at the same time, automatic performance of the two phrases corresponding to the switches 72 and 73 is added to the normal automatic performance.

It should also be appreciated that the phrase performance data may be recorded by the user as desired or may be factory-preset in a ROM or the like. Likewise, the quantization value may be established by the user as desired or may be factory-preset. Further, the phrase performance data may be any of percussion instrument performance data, melody performance data and accompaniment data.

The quantization data, although has been described above as being stored in the header of the phrase performance data, may be stored in a different location from the phrase performance data.

Further, although the phrase performance has been described above as being instructed by the user's switch operation, specific start instructing data may be prestored between automatic performance data so as to allow the phrase performance to get started in an automatic fashion.

In accordance with the invention as has been described above in conduction with FIGS. 1 to 8, when start of a second automatic performance is instructed during progression of a first automatic performance, the second automatic performance is caused to start at a predetermined timing of the first automatic performance in such a manner that the first and second automatic performances are properly synchronized with each other, with the result that it is possible to achieve musically preferable automatic performance.

Next, another embodiment of the present invention will be described with reference to FIGS. 9 to 19.

Figure 10:
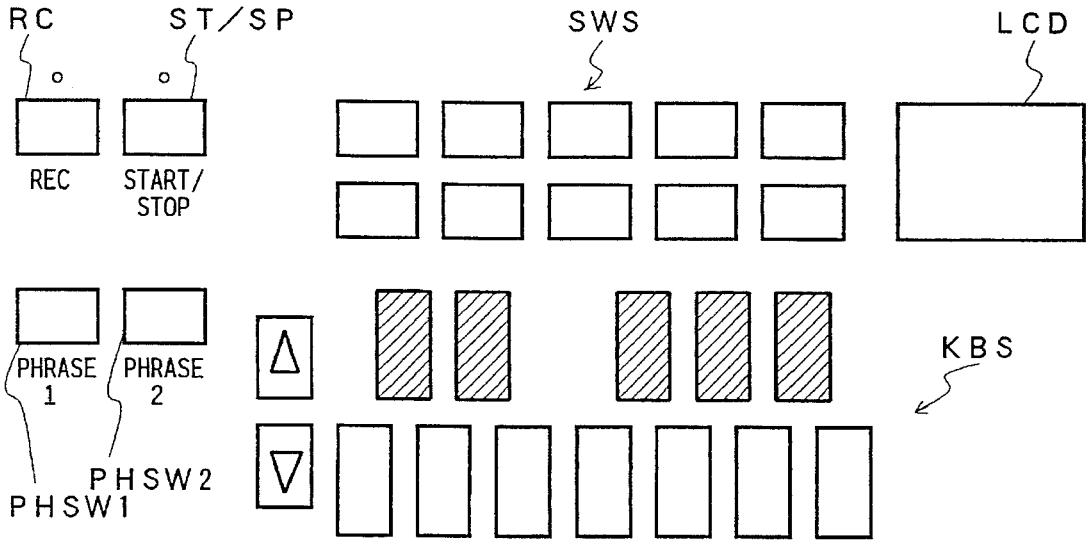
FIG. 10 a diagram showing by way of example the principal portion of a switch panel section shown in FIG. 9.

FIG. 9 is a block diagram illustrating the general hardware structure of an automatic performance device in accordance with another embodiment of the present invention. In this figure, a switch panel section 21 has a plurality of switches provided thereon. The principal portion of the switch panel section 21 is shown in FIG. 10. As shown, the principal portion of the switch panel section 21 has a group of switches, which includes a plurality of keyboard switches KBS, a recording switch RC, a start/stop switch ST/SP, phrase switches PHSW1 and PHSW2, and other switches SWS. In addition, there are provided LEDs (Light Emitting Diodes) which are lit in response to operation of the recording switch RC and start/stop switch ST/SP, as well as an LCD (Liquid Crystal Display) for showing various operation modes of the automatic performance device, etc. The phrase switches PHSW1 and PHSW2 will be later described in detail. Further, in FIG. 9, a switch operation detecting circuit 22 is provided for detecting on/off-event of each of the switches on the switch panel section 21.

A ROM 23 stores therein control programs, 100 phrase data and the like. The phrase data will be later described in detail. A RAM 24 is provided for storing song data etc. and also functioning as various registers and flags. Further, the RAM 24 contains song playing and recording tracks. The song playing track stores song data and is used for reproduction purposes. The song recording track is used for recording event data simultaneously as the song playing track data are reproduced, so as to permit overdubbing (i.e., recording performance data on previously recorded performance data in a superimposed fashion). The data thus recorded on the song recording track are mixed with the data in the song playing track. The detail of the song data will be described later.

A CPU 25 fetches a detection result from the switch operation detecting circuit 22, so as to control various components such as a tone source circuit 25 and a display circuit 30 on the basis of the data stored in the ROM 23 and RAM 24. A timer 26 outputs timer interrupt signals to the CPU 25 at predetermined time intervals (e.g., 24 times per quarter note). The frequency of the timer interrupt signals is variable depending upon selected tempos. The tone source circuit 27 generates a tone signal in digital format on the basis of various information supplied by the CPU 25. A D/A (Digital-to-Analog) converter 28 converts the digital output signal of the tone source circuit 27 into analog format and provide the analog signal to a loud speaker 29. The loud speaker 29 audibly reproduces the analog signal as a tone. The display circuit 30 includes the above-mentioned LEDs and LCD provided on the switch panel section, etc.

Now, a description will be given below on the phrase switches PHSW1, PHSW2 provided on the switch panel section 21. To the respective phrase switches PHSW1, PHSW2 are assigned two of the 100 phrase data stored in the ROM 23. Such an assignment is done as desired by the user's operation of an unillustrated phrase assigning switch or the like. In response to the operation of the phrase switch PHSW1 or PHSW2, the phrase data assigned thereto is read out so that a phrase performance tone based on the data is generated.

Figure 11:
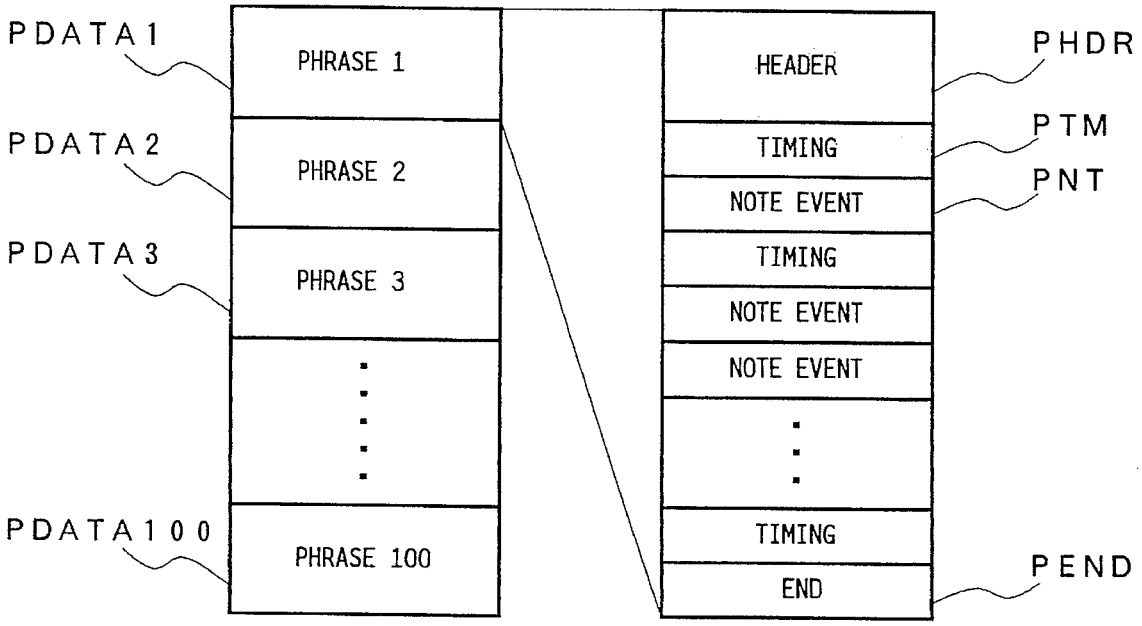
FIG. 11 is a diagram illustrating the format of phrase data used in the embodiment of FIG. 9.

Next, a description will be made below, with reference to FIG. 11, on the data format of the phrase data stored in the ROM 23. The individual phrase data PDATAn (n=1 to 100) are allotted phrase numbers n from 1 to 100, respectively. In each of the phrase data, there are stored, as a header PHDR, tone color of the phrase (for instance, tone color of piano or saxophone in the case of a melodic phrase, or, tone color of rock drum or jazz drum in the case of a drum phrase), a phrase timing, etc. The phrase timing data is indicative of a phrase reproduction timing during a song reproduction, and this timing data functions to allow a phrase performance to be initiated at a beginning of beat in synchronism with the song performance even when operation timing of the phrase switch PHSW or PHSW2 is not exactly coincident with the beat timing of the song performance. The phrase timing data is expressed in terms of, for example, a quarter note or eighth note. However, in such a case where data for one tone such as that of cymbal or the like is stored as the phrase data and this phrase data is reproduced in synchronism with the operation of the phrase switch PHSW1 or PHSW2, the arrangement may be such that the phrase timing data is not set as described above.

Following the header PHDR, there are stored timing data PTM which, as data indicative of a note event occurrence timing, represents an interval between note events in terms of the number of clocks (the minimum resolution of the timing data will be called a "clock" and the clock corresponds to a generation interval of interrupt signals provided by the timer 6, and note event data PNT indicative of a note event to occur at the timing indicated by the timing data PTM.

The note event data PNT is composed of note-on/note-off data indicative of tone generation start/end, note number indicative of a tone pitch (or a type of percussion instrument in the case of drum) and velocity data which principally corresponds to tone intensity. At the end of the phrase data, end data PEND is stored which is indicative of the end of the phrase. In the embodiment, the phrase data PDATAn has a total data length to cover only one measure, so that, once the end data PEND is read out with the phrase data PHSW1 or PHSW2 depressed, first timing data PTM is again read out for repetition of the same phrase performance.

Figure 12:
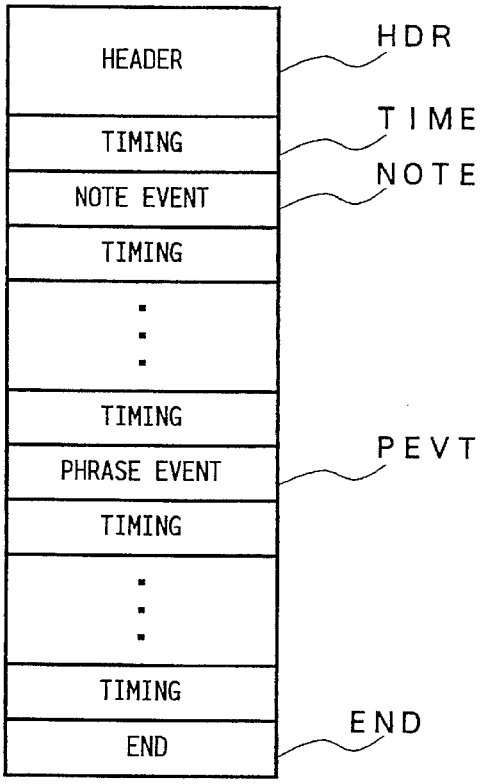
FIG. 12 is a diagram illustrating the format of song data used in the embodiment of FIG. 9.

Further, in FIG. 12, there is illustrated the format of song data. As illustrated, the song data is composed of a header HDR defining initial tone color and tempo etc. of the song, and, similarly to the above-mentioned phrase data, note event data NOTE which includes timing data TIME indicative of an event interval, note-on/note-off data and velocity data, phrase event data PEVT relating to operation of the phrase switches PHSW1, PHSW2, and end data END.

The phrase event data PEVT is composed of phrase switch operation data, i.e., data indicative of depression of the phrase switch PHSW1 or PHSW2, a phrase number of phrase data PDATAn assigned to the depressed phrase switch PHSW1 or PHSW2, and data indicative of the length of depression of the phrase switch PHSW1 or PHSW2 which will hereinafter be called a gate time). End data END is indicative of the end of the song.

Next, a description will be made on the operation of the automatic performance device accordance with the embodiment.

OUTLINE OF THE OPERATION

Figure 13:
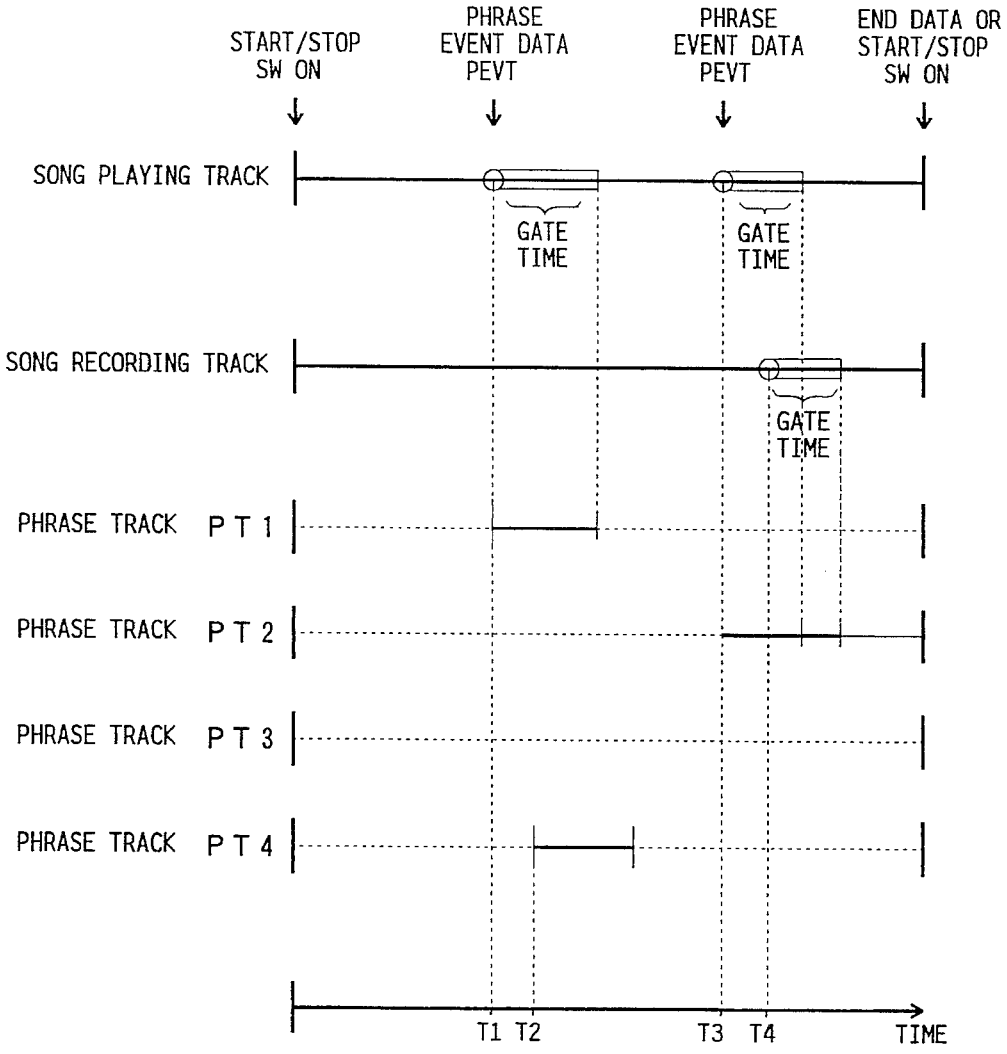
FIG. 13 is a diagram explanatory of various tracks in the embodiment of FIG. 9.
Figure 14:
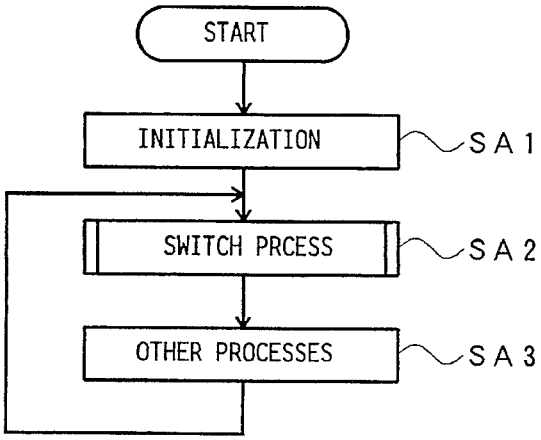
FIG. 14 is a flowchart of an example of a main routine carried out by a CPU shown in FIG. 9.

First, the outline of various processing executed in the embodiment will be described with reference to FIG. 13, which shows, along a time axis, the song playing and recording tracks provided in the RAM 24, and imaginary phrase tracks PT1–PT4. The operation is somewhat different between reproduction and recording.

When a normal automatic performance is to be executed, i.e., the song playing track is to be reproduced, the song playing track is read by the CPU 25 from a time point when the start/stop switch ST/SP is depressed to a time point when the switch ST/SP is again depressed (or to a time point when the end data END is reached), so as to provide note event data NOTE, and thereby an automatic performance of song is executed. In the meantime, phrase event data PEVT is read at time point T1. At that time, if operation data of the phrase switch PHSW1 is prestored as the phrase event data PEVT, phrase data PATAn of a phrase number indicated by the phrase event data PEVT is read out from the ROM 23 as data for the phrase track PT1 and reproduced for a time indicated by the gate time of the phrase event data PEVT. In other words, a phrase event of the phrase switch PHSW1 read out from among the song data works as data for the phrase track PT1.

It is assumed that, then, at time point T2, the phrase switch PHSW2 is operated by the user during reproduction of the song playing track. In such a case, phrase data PDATAn assigned to the phrase switch PHSW2 is read out from the ROM 23 as data for the phrase track PT4, so that, from this time point T2 on, the phrase track PT4 is reproduced simultaneously with reproduction of the phrase track PT1. Namely, the operation of the phrase switch PHSW2 works for the phrase track PT4. In this way, two phrases are reproduced in parallel.

Similarly to the above-mentioned, if operation data of the phrase switch PHSW2 is prestored as the phrase event data PEVT, phrase data PATAn of a phrase number indicated by the phrase event data PEVT is read out from the ROM 23 as data for the phrase track PT2. Further, when the phrase switch PHSW1 is operated by the user, phrase data PDATAn assigned to the phrase switch PHSW1 is read out from the ROM 23 as data for the phrase track PT3. As may be apparent from the above-mentioned, the phrase tracks PT1, PT2, PT3, PT4 respectively correspond to an event of the phrase switch PHSW1 during the song performance, an event of the phrase switch PHSW2 during the song performance, the user's operation of the phrase switch PHSW1 and the user's operation of the phrase switch PHSW2. The phrase tracks work independently of each other. Because of such arrangements, four phrases can be simultaneously reproduced in the embodiment.

Thereafter, once the start/stop switch ST/SP is again depressed, or when end data END is read out from among the song data, readout of the song data is terminated.

Next, a description will be given on recording (overdubbing) of song data. It is assumed that, after readout of song data is initiated in response to depression of the recording switch RC and subsequent depression of the start/stop switch ST/SP, phrase event data PEVT is, similarly to the above-mentioned, read out from the song playing track at time point T3, and also that the read-out phrase event data PEVT contains operation data of the phrase switch PHSW2. In such a case, phrase data PDATAn of a phrase number indicated by the phrase event data PEVT is read out from the ROM 23 as data for the phrase track PT2, and then the phrase track PT2 is reproduced from time point T3 on.

Thereafter, if the phrase data PHSW2 is operated at time point T4, the phrase data PDATAn assigned to the switch PHSW2 is read out from the ROM3 as data for the phrase track PT2. Namely, during the song recording, the user's operation of the phrase switch PHSW2 works for the phrase track PT2. This is done for making the states consistent because an event of the phrase switch PHSW2 thus recorded works for the phrase track PT2 during reproduction. This causes the phrase data PDATAn assigned to the switch PHSW2 to be reproduced in place of the phrase data PDATAn having been reproduced till time point T4. Then, into the song recording track are recorded the operation data for the phrase switch PHSW2, phrase number of the newly recorded phrase data PDATAn and gate time of the phrase switch PHSW2.

If, on the other hand, the phrase switch PHSW1 is operated at the above-mentioned time point T4 in stead of the phrase switch PHSW2, the phrase data PDATAn assigned to the switch PHSW1 is read out from the ROM 23 as data for the phrase track PT1. Namely, the user's operation of the phrase switch PHSW1 during the recording works for the phrase track PT1. Because of this, from time point T4 on, the phrase tracks PT1 and PT2 are reproduced simultaneously so that two phrases are reproduced in parallel, and also this phrase event data PEVT is recorded into the song recording track.

Further, if phrase event data PEVT is read out from the song playing track while, in response to the operation of the phrase switch PHSW1 or PHSW2, the corresponding phrase data PDATAn is read out for reproduction as data for the phrase track PT1 or PT2, the phrase reproduction responsive to the operation of the phrase switch PHSW1 or PHSW2 is terminated and phrase data PDATAn designated by the read-out phrase event data PEVT is reproduced with priority.

Then, after the start/stop switch ST/SP is depressed again and thus the reproduction from the song playing track and the recording into the song recording track are terminated, the phrase data PDATAn recorded in the song recording track is mixed into the song playing track in such a manner that the playing track is renewed, and the overdubbing is put to an end.

It should be appreciated that, in effect, the phrase data PDATAn is not reproduced upon the operation of the phrase switch PHSW1 or PHSW2 but upon arrival of the phrase timing.

DETAIL OF THE OPERATION

First, various registers and flags will be described below which are used for controlling the operation. These registers and flags are provided in a predetermined storage area within the RAM 24.

Recording Switch Flag REC: This flag is set at "1" when the device is in the recording-enabled state, otherwise it is set at "0".

Song Play/Nun Flag SRUN1: This flag is set at "1" while data of the song playing track is reproduced.

Song Recording Run Flag SRUN2: This flag is set at "1" while data is recorded into the song recording track.

Phrase Run Flags PHRUN1–PHRN4: Each of these flags is set at "1" while phrase data PDATAn is read out.

Song Play Time Register STIME1: This is a time register which indicates an event interval used in reproducing from the song playing track. Once the register counts down to "0", next stored event data is read out.

Song Recording Time Register STIME2: This is a register for counting elapsed time since a last event during recording.

Phrase-on Flags PHON1–PHON4: Each of these flags is set at "1" when phrase event data PEVT is read out, or when the phrase switch PHSW1 or PHSW2 is operated.

Phrase Number Registers PHNUM1–PHNUM4: Each of these registers stores the phrase number of phrase data PDATAn to be read out.

Gate Time Registers GATE1, GATE2: Each of these registers stores a gate time (switch depression time) from a time point when an on-event of the corresponding phrase switch PHSW1 or PHSW2 is detected to a time point when an off-event of the switch is detected.

Phrase Assignment Registers PHASIN1, PHASIN2: Each of these registers stores the phrase number assigned to the corresponding phrase switch PHSW1 or PHSW2.

Phrase Time Registers PHTIME1–PHTIME4: Each of these registers indicates an event interval in the phrase data PDATAn. Once the register counts down to "0", next stored event data is read out.

Next, with reference to flowcharts shown in FIGS. 14–19, a detailed description will be made below on the operation of the automatic performance device in accordance with the embodiment. Upon switching-on of an unillustrated power source of the automatic performance device, the CPU 25 initiates execution of a main routine flowcharted in FIG. 14. First, an initialization process is executed in step SA1.

This initialization process initializes various registers and flags such as the above-mentioned which are provided within the RAM 24. Then, the CPU 25 executes a switch process in step SA2 as will be later described. Thereafter, a display process and other processes are executed in step SA3. After step SA3, the routine loops back to step SA2 so that the CPU 25 repetitively executes operations in steps SA2 and SA3.

CASE 1: Description on Normal Performance (where no operation of the phrase switches PHSW1, PHSW2 is involved)

(1) Switch Process

First, a normal real-time performance will be described. In this normal real-time performance, the player performs by operating the keyboard switches KBS. Further, in order to perform a desired phrase, the player also operates the phrase switch PHSW1 or PHSW2 in such a manner that phrase data assigned to the operated phrase switch PHSW1 or PHSW2 is reproduced by means of the corresponding phrase track PT3, PT4. The following is a detailed description of such an operation.

Figure 15:
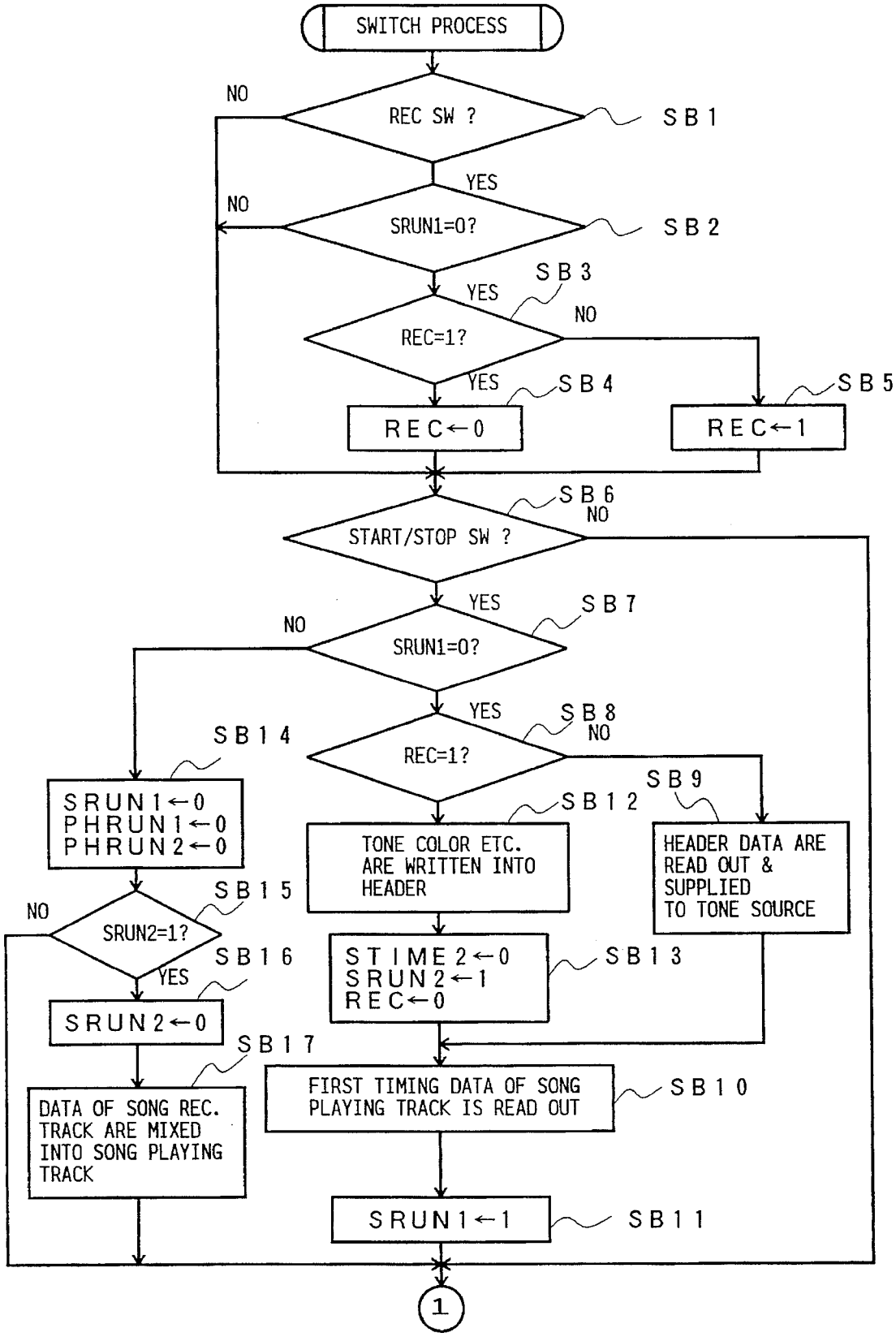
FIG. 15 is flowchart illustrating a part of an example of a switch process shown in FIG. 14.
Figure 16:
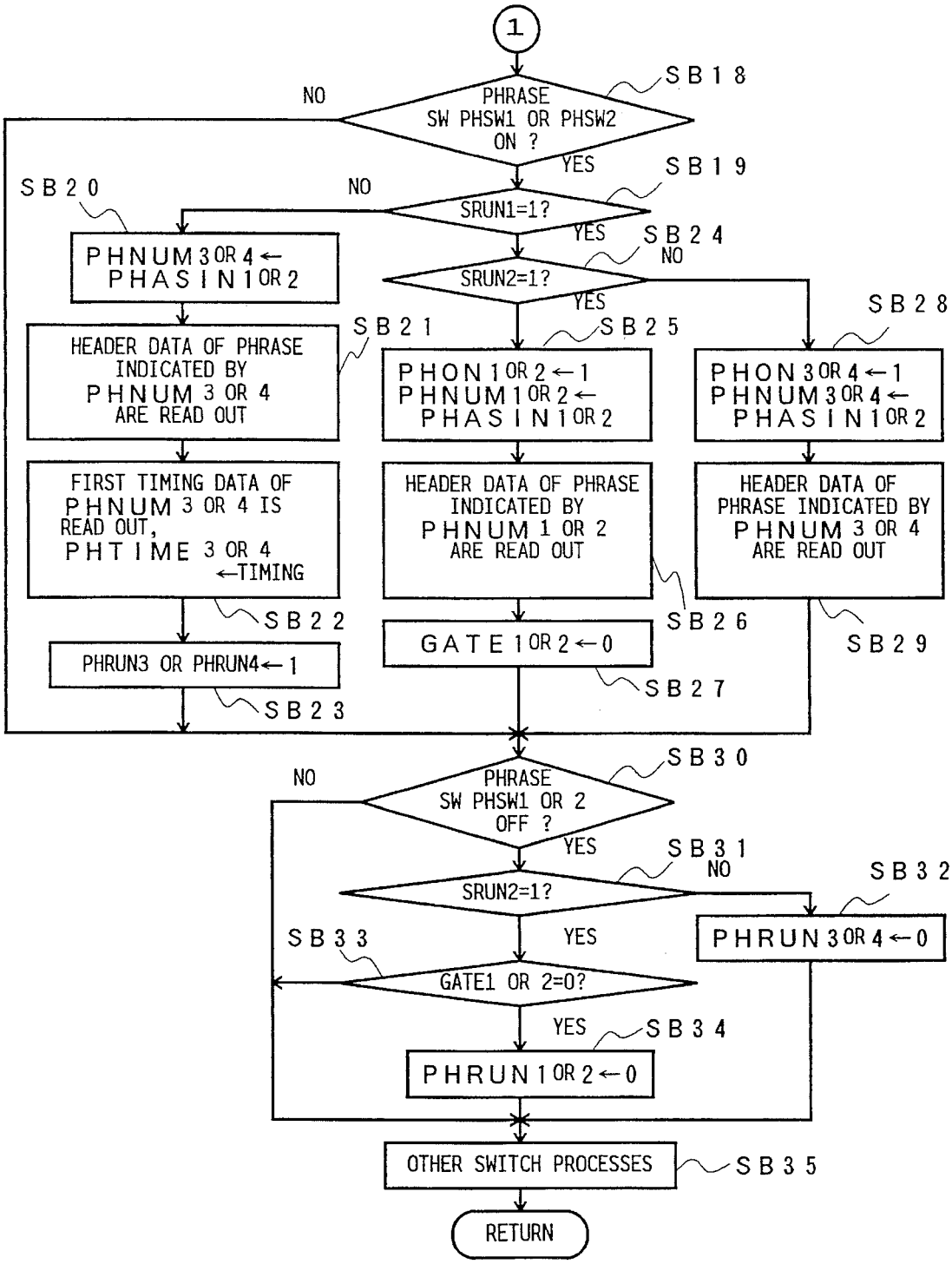
FIG. 16 is a flowchart illustrating the remaining part of the switch process.

FIGS. 15 and 16 illustrates the flow of the switch process routine executed in step SA2 above. First, in step SB1, a determination is made as to whether an on-event of the recording switch RC has been detected. In this case, a NO determination is obtained, and thus the program branches to step SB6, where it is further determined whether an on-event of the start/stop switch ST/SP has been detected. In this case, a NO determination is obtained, and thus program jumps to step SB18 shown in FIG. 16.

<Process for Phrase Switch PHSW1, PHSW2 >

Next, in step SB18, a determination is made as to whether an on-event of the phrase switch PHSW1 or PHSW2 has been detected. If the phrase switch PHSW1 or PHSW2 has not been operated by the player, a NO determination is obtained, and the program jumps to step SB30. In step SB30, it is determined whether an off-event of the phrase switch PHSW1 or PHSW2 has been detected. If answered in the negative, the program moves to step SB35 to execute other switch processes. In the other switch processes, if any of the keyboard switches KBS, or the like has been operated on the switch panel section, corresponding flags are set to indicate the presence of the switch operation; if the phrase assigning switch has been operated, phrase data PGATAn is assigned to the phrase switch PHSW1 or PHSW2 and the phrase number of the assigned phrase data PDATAn is set into the phrase assign register PHASIN1, PHASIN2. After that, the program returns to the main routine.

(2) Timer Interrupt Process

Figure 17:
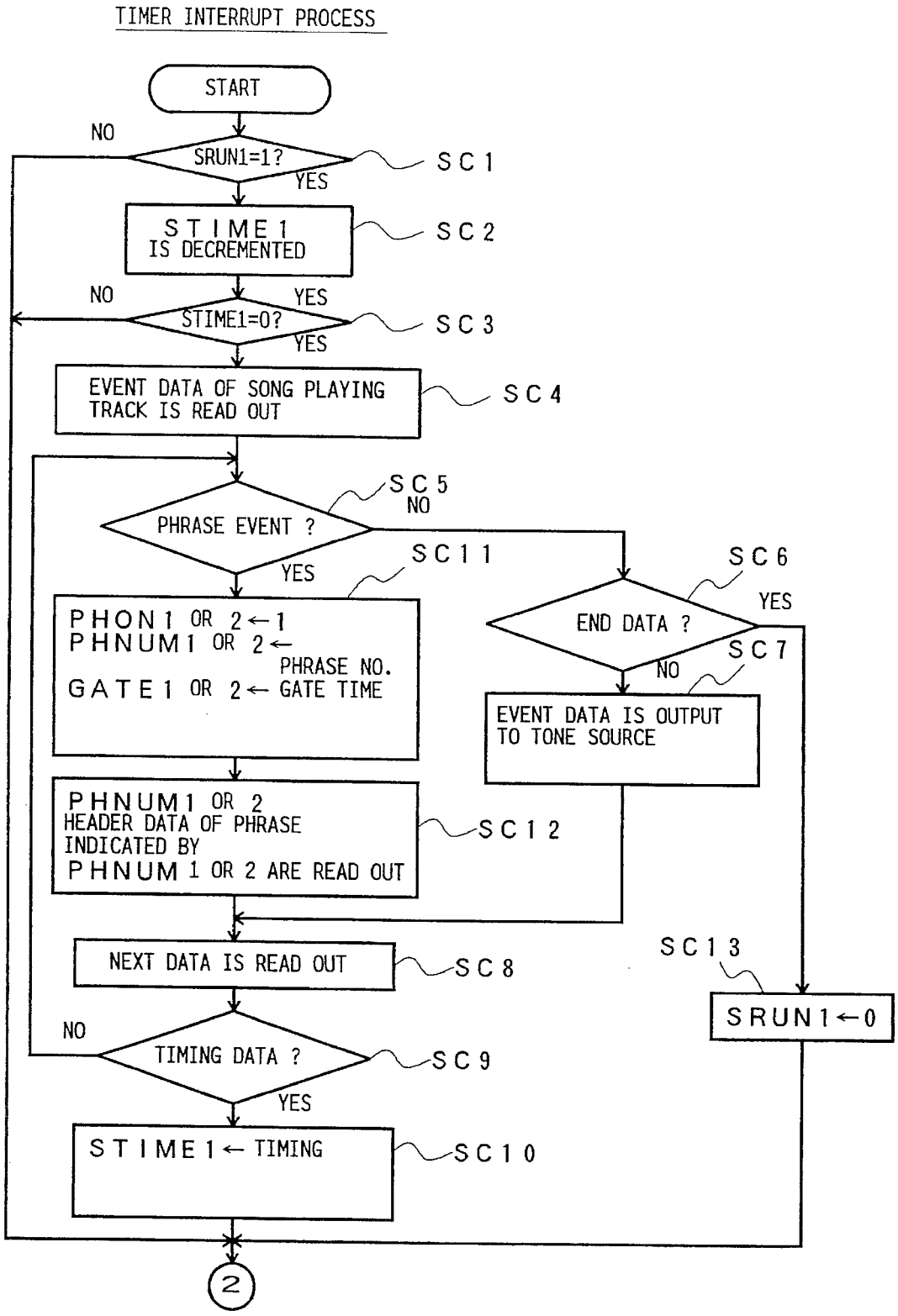
FIG. 17 is a flowchart of a part of an example of a timer interrupt process carried out by the CPU shown in FIG. 9.
Figure 18:
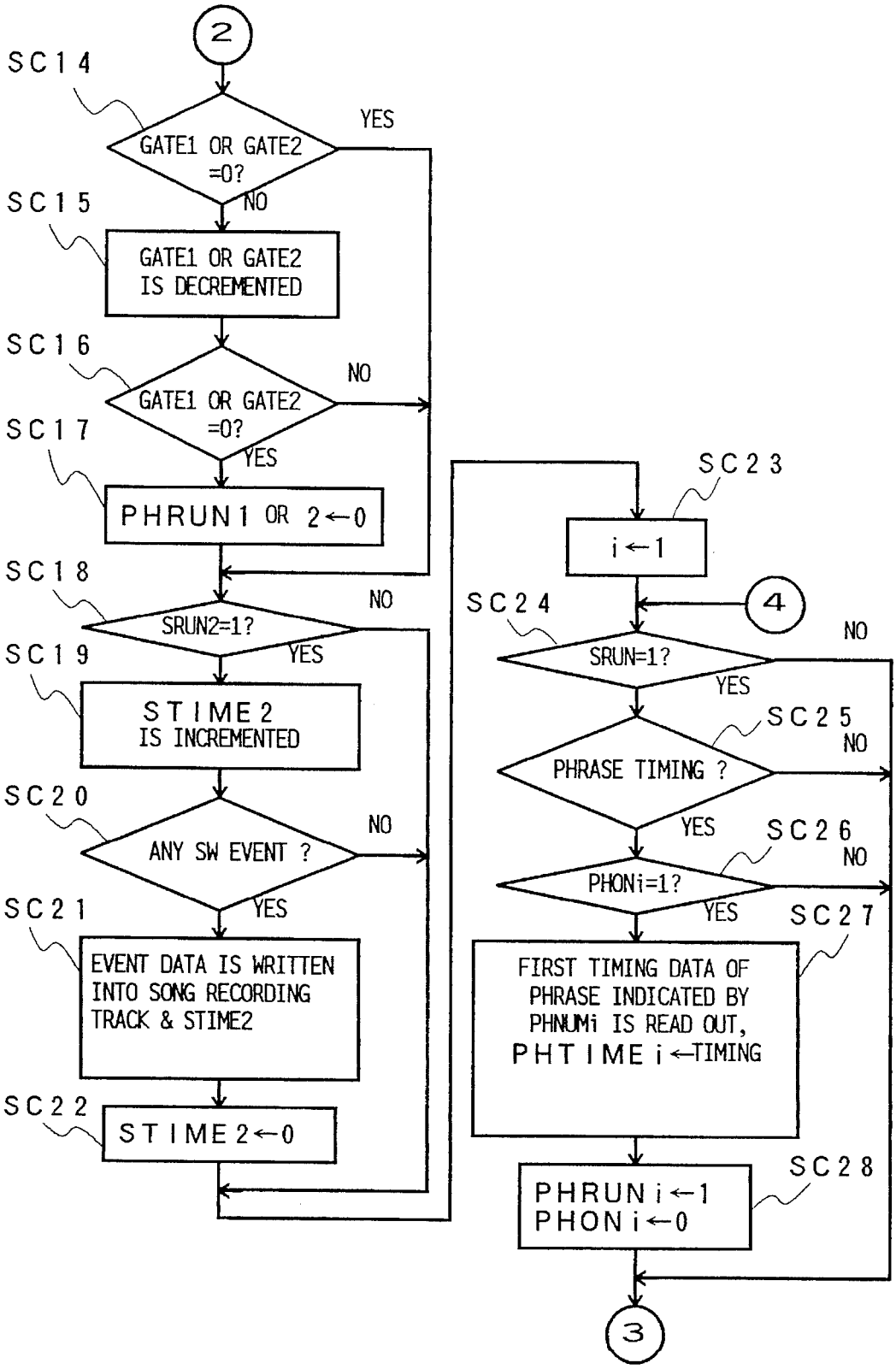
FIG. 18 is a flowchart illustrating another part of the timer interrupt process which is to be connected to the part of FIG. 17.
Figure 19:
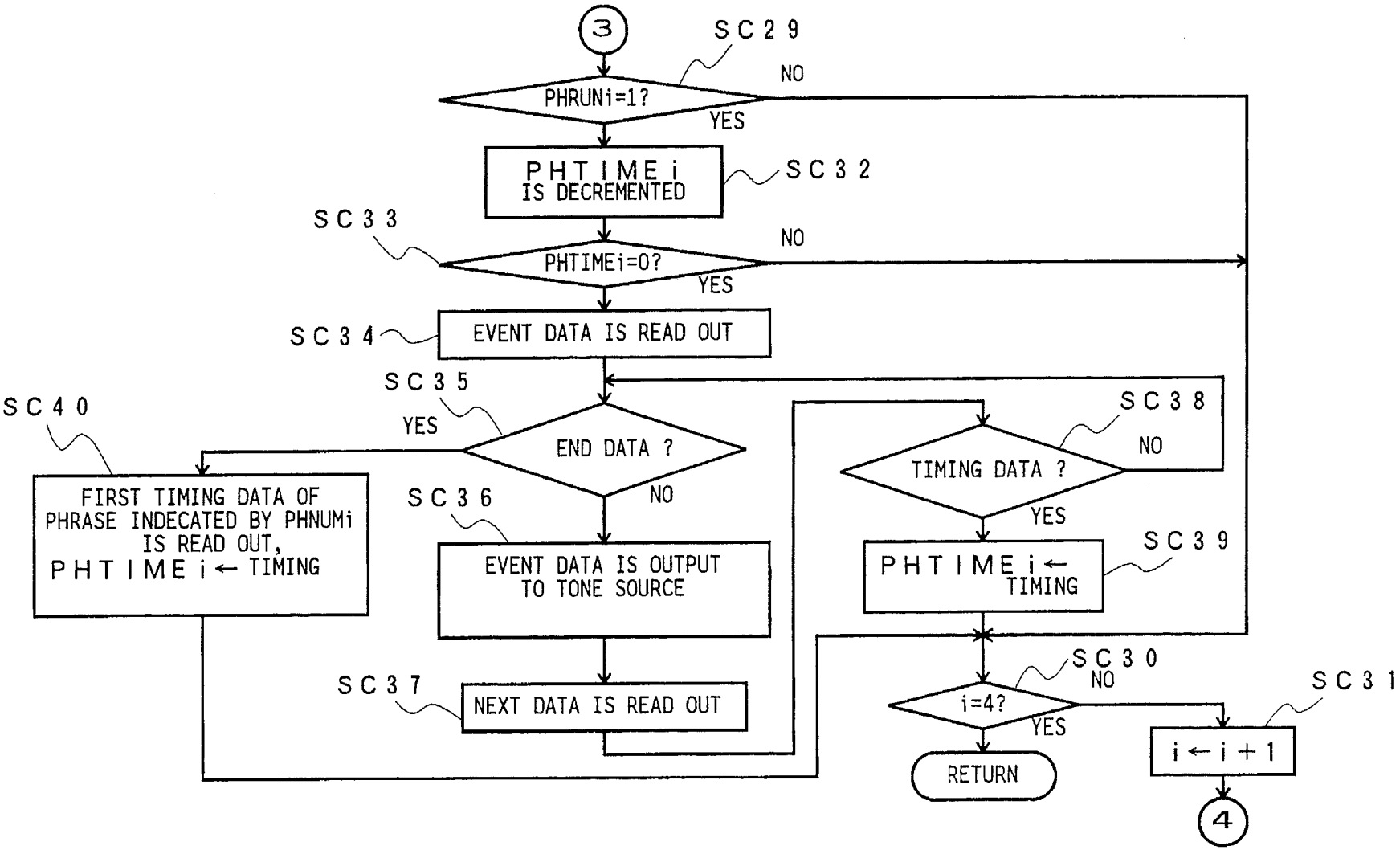
FIG. 19 is a flowchart illustrating the remaining part of the timer interrupt process which is to be connected to the part of FIG. 18.

In parallel with the above-mentioned main routine, the CPU 25 executes a timer interrupt process in response to each timer interrupt given by the timer 26. FIGS. 17 to 19 illustrate the flow of this timer interrupt process. First, in step SC1, it is determined whether the song play run flag SRUN1 is at "1". The determination becomes "NO" in the normal performance, and then the program jumps to step SC14 shown in FIG. 18 to further determine whether the gate time register DATE1 or GATE2 is at "0". Unless any phrase is being read out on the basis of phrase event data PEVT from among the song data, the determination in step SC14 becomes "YES", and this "YES" determination directs the program to step SC18 to further determine whether the song recording run flag SRUN2 is at "1". Since the song recording run flag SRUN2 is at "0" in this case, the determination in step SC18 becomes "NO", and the program moves to step SC23.

<Reproduction Process on Phrase Data PDATAn >

Next, in step SC23, the value of a counter i is set at "1". Then, the program goes to step SC24 to determine whether the song play run flag SRUN1 is at "1". Since the song play run flag SRUN1 is at "0" in this case, a "NO" determination is obtained in step SC24, and then the program jumps to step SC29 shown in FIG. 19. In step SC29, a determination is made as to whether the phrase run flag PHRUNi is at "1". In this case, the determination in step SC29 becomes "NO", so that the program goes to step SC30. In step SC30, it is determined whether the counter i is at "4". If answered in the negative, step SC31 is taken to increment the value in the counter i. After that, the program reverts to step SC24 to repeat steps SC29, SC30, SC31 until the value in the counter i becomes "4", upon which the determination in step SC30 becomes "YES", thus the timer interrupt process being terminated.

CASE 2: Description on Normal Process (where the phrase switch PHSW1 or PHSW2 is involved)

(1) Switch Process

If, on the other hand, the phrase switch PHSW1 or PHSW2 has been operated in the above-mentioned processing, the determination in step SB18 of FIG. 18 becomes "YES", thus the program goes to step SB19, in which it determined whether the song play run flag SRUN1 is at "1" When the automatic performance is not in progress, the determination in step SB19 becomes "NO", and the program moves to step SB20. In step SB30, if the phrase switch PHSW1 has been operated, the content in the phrase assignment register PHASIN1 is set into the phrase number register PHNUM3. If, on the other hand, the phrase switch PHSW2 has been operated, the content in the phrase assignment register PHASIN2 is set into the phrase number register PHNUM4. Then, the program moves to step SB21, where various setting operations are executed such as for reading out from the ROM 23 the header data PHDR of the phrase data PDATAn indicated by the phrase number register PHNUM3 or PHNUM4 and thereby supplying the tone color data to the tone source circuit 27.

Next, in step SB22, the first timing data PTM in the phrase data PDATAn is read out and set into the phrase time register PHTIME3 or PHTIME4. Then, step SB23 is taken to set the phrase time register PHTIME3 or PHTIME4 at "1". So, the determination in step SB30 becomes "NO", which causes the program to move to step SB35 to execute other processes. After that, the program returns to the main routine.

(2) Timer Interrupt Process

In this case, the determination in step SC1 becomes "NO", which moves the program to step SC14. The determination in step SC14 becomes "YES", which causes the program to move to step SC18. Because in this case the song run flag SRUN2 is not at "1", the determination in step SC18 becomes "NO", which causes the program to move to step SC23 of FIG. 18.

<Reproduction Process on Phrase Data PDATAn >

Next, in step SC23, the value in the counter i is set at "1". A "NO" determination is obtained in step SC24, and then the program jumps to step SC29 shown in FIG. 19. In step SC29, a determination is made as to whether the phrase run flag PHRUNi is at "1". If answered in the negative in step SC29, the program goes to step SC30. In step SC30, it is determined whether the counter i is at "4". If answered in the negative, step SC31 is taken to increment the value in the counter i. After that, the program reverts to step SC24 to repeat steps SC29, SC30, SC31 as described above.

Because, in this case, the phrase switch PHSW1 or PHSW2 has been operated and the phrase run flag PHRUN3 or PHRUN4 has been set at "1" in step SB23 of the switch process, the determination in step SC29 becomes "YES" when the value in the counter i reaches "3" or "4", and the program moves to step SC32. Step SC32 decrements the value in the phrase time register PHTIME3 set in step SB22. In next step SC33, it is determined whether the phrase time register PHTIME3 is at "0". If the phrase time register PHTIME3 has not yet reached "0", the program goes to step SC30.

Thereafter, whenever the timer interrupt process is executed, the value in the phrase time register PHTIME3 is decremented in step SC32. Once the phrase time register PHTIME3 has reached "0", i.e., once an event occurrence timing has reached, the determination in step SC33 becomes "YES", which causes the program to move to step SC34. After that, in step SC34, event data of the phrase data PDATAn indicated by the phrase number register PHNUM3 is read out from the ROM 23. Then, step SC35 is taken to determine whether the read-out event data is end data PEND. If the determination is in the affirmative, i.e., if the read-out event data is note event data PNT, step SC36 is taken to output the note event data to the tone source circuit 27.

Next, next data is read out in step SC37, and a determination is made in step SC38 as to whether the read-out data is timing data. If answered in the negative, it means that the read-out data is note event data PNT or end data PEND, and thus step SC35 is taken. Thereafter, event data are sequentially output to the tone source circuit 27 in step SC36 until timing data PTM or end data PEND is read out.

If timing data PTM is read out in step SC37, the determination in step SC38 becomes "YES", and thus the program goes to step SC39 to load the timing data PTM into the phrase time register PHTIME3 or PHTIME4. Then, if the value in the counter i is "3" in step SC30, the program branches to step SC31 and reverts to step SC24. If the value in the counter i is "4" in step SC30, the program returns to the main routine. Then, the program repeats the above-mentioned processing to output event data at predetermined timings, until the data read out in step SC34 or SC37 is end data PEND.

If the read-out data is end data PEND, a "YES" determination is obtained in step SC35, and the program moves to step 40. In step SC40, first timing data PTM of the phrase data PDATAn indicated by the phrase number register PHNUM3 or PHNUM4 is read out and loaded into the phrase timing register PHTIME3 or PHTIME4. Because of this, in the subsequent timer interrupt process, the phrase data PDATAn will be repetitively reproduced from its lead.

As mentioned, reproduction of the imaginary phrase tracks PT1–PT4 is achieved by setting the counter i at values 1 to 4 and executing the respective processing on the basis of the registers, In this instance, the counter at "3" indicates reproduction of the phrase track PT3.

(3) Switch-off Process for Phrase Switch PHSW1, PHSW2

If the phrase switch PHSW1 or PHSW2 that has been in the switched-on state is switched off, the determination in step SB30 of the switch process becomes "YES", which causes the program to move to step SB31. In this step SB31, it is determined whether the song recording run flag SRUN2 is at "1". If the determination in the negative, i.e., if recording into the song recording track is not in progress, step SB32 is taken to set "0" into the phrase run flag PHRUN3 or PHRUN4. This terminates the phrase reproduction based on the operation of the phrase switch PHSW1 or PHSW1.

CASE 3: Description on a Song Data Reproduction Process (where song data alone is reproduced)

(1) Switch Process

Now, a description will be made below on the operation when an automatic performance is executed by reproducing the song data shown in FIG. 12. By operating the start/stop switch ST/SP, song data is reproduced for execution of an automatic performance. Once the start/stop switch ST/SP is operated, the determination in step SB6 becomes "YES", which causes the program to move to step SB7. In step SB7, it is determined whether the song play run flag SRUN1 is at "0". In this case, the determination in step SB7 becomes "YES", In this case, the determination in step SB8 to determine whether the recording switch flag RC is at "1". Since the recording switch RC has not been operated, a "NO" determination is obtained in step SB8, which causes the program to move to step SB9. In step SB9, various processes are executed such as for reading out data (tone color, tempo etc.) in the header HDR of the song data shown in FIG. 12 and supplying the read-out data to the tone source circuit 27.

After that, the program goes to step SB10 to read out first timing data TIME in the song playing track and loading the read-out timing data TIME into the song play time register STIME1. Subsequently, step SB11 is taken to set the song play run flag at "1". This allows the song data to be ready for reproduction.

Further, because the phrase switch PHSW1 or PHSW2 has not been operated at this time, the determination in step SB18 becomes "NO", which causes the program to move to step SB30. The determination in step SB30 also becomes "NO", which causes the program to move back to the main routine via step SC35.

(2) Timer Interrupt Process

<Song Playing Track Readout Process >

Now, a description will be given below on a timer interrupt process in the above-mentioned processing. In this case, because the song play run flag SRUN1 has been set at "1" in step SB11 of the above-mentioned switch process, the determination in step SC1 becomes "YES", which causes the program to move to step SC2. Step SC2 decrements the value in the song play time register STIME1 loaded in step SB10. Then, in step SC3, it is determined whether the song play time register STIME1 has reached a value of "0". If answer ed i n the negative, the program goes SC14. Thereafter, each time the timer interrupt process is executed, the value in the song play time register STIME1 is decremented. As the result, once the song play time register STIME1 has reached "0", it means that an event occurrence timing has been reached, and thus the determination step SC3 becomes "YES", which causes the program to step SC4. Then, in this step SC4, event data in the song playing track is read out. This event data is the one stored immediately after the timing data read out last.

Then, the program goes to step SC5 to determine whether the read-out event data is phrase event data PEVT.

If the read-out data is note event data NOTE, the determination in step SC5 becomes "NO" and the program goes to step SC6. In step SC6, it is further determined whether the event data is end data END. Because the determination in step SC6 is in the negative in this case, step SC7 is taken to output the note event data NOTE to the tone source circuit 27. This allows the tone source circuit 27 to form a tone signal based on the above-mentioned data. The tone signal is converted into analog representation and audibly reproduced via the loud speaker 9.

Upon termination of step SC7, the program goes to step SC8 to read out next stored data in the song playing track. Next, in step SC9, it is determined whether the read-out data is timing data TIME. If the determination is in the negative. i.e., if plural events have occurred at the same timing, the program goes back to step SC5. If the read-out data is note event data NOTE, a process to generate a tone signal is executed in a similar manner to the above-mentioned.

If, on the other hand, the event data read out in step SC4 or SC8 is phrase event data PEVT, the determination in step SC5 becomes "YES", which causes the program to move to step SC11. In step SC11, if the phrase event data PEVT has a record that the phrase switch PHSW1 has been operated. "1" is set into the phrase-on flag PHON1, the phrase assigned to the phrase switch PHSW1 is set into the phrase number register PHNUM1, and the gate time of the phrase PHSW1 is set into the gate time register GATE1. If the phrase event data PEVT has a record that the phrase switch PHSW2 has been operated, "1" is set into the phrase-on flag PHON2, the phrase number assigned to the phrase switch PHSW2 is set into the phrase number register PHNUM2, and the gate time of the phrase switch HSW2 is set into the gate time register GATE2.

Next, in step SC12, various setting processes are executed such as for reading out from the ROM 23 data in the header PHDR of the phrase data PDATAn indicated by the phrase number PHNUM1 (or OHNUM2). Then, step SC8 is taken to read out next data. Then, in step SC9, a determination is made as to whether the read-out data is timing data TIME. If answered in the negative in step SC9, the program goes back to step SC5 to repeat the above-mentioned processes. If the read-out data is timing data TIME, a "YES" determination is obtained in step SC9, which causes the program to move to step SC10 to set the timing data TIME into the song play time register STIME1.

Upon completion of step SC10, the program goes to step SC14. If phrase event data PEVT has been read out in the above-mentioned process, it means that a predetermined gate time has been set into the gate time register GATE1 (or GATE 2), and thus the determination in step SC14 becomes "NO". Next, step SC15 is taken to decrement the value in the gate time register GATE1 (or GATE 2), and in step SC16, it is determined whether the gate time register GATE1 (or GATE 2) has reached "0". If answered in the negative in step SC16, i.e., if a timing for terminating reproduction of the phrase event data PEVT has not been reached, the program moves to step SC18. After that, each time the timer interrupt process is executed, the value in the gate time register GATE1 (or GATE 2) is decremented in step SC15. Then, the program goes to steps SC18 and SC23.

<Reproduction Process on Phrase Data PDATAn >

Next, the counter i is set at "1" in step SC23, and the program goes to step SC24. If reproduction from the song playing track is in progress, a "YES" determination is obtained in step SC24, which causes the program to move to step SC25. In step SC25, it is determined whether a phrase timing has been reached. This phrase timing is one that is set when the header PHDR of the phrase data PDATAn is read out and is a value corresponding to the length of a quarter or eight note which is peculiar to each phrase. If a phrase timing has not been reached, the determination in step SC25 becomes "NO", which causes the program to move to step SC29; if a phrase timing has been reached, the determination in step SC29 becomes "YES", which causes the program to move to step SC26.

In such a case where phrase event data PEVT has been read out and the phrase-on flag PHON1 is at "1", the determination in step SC26 is in the affirmative, which causes the program to move to step SC27. In step SC27, first timing data PTM in the phrase data PDATAn indicated by the phrase number register PHNUM1 is read out and set into the phrase time register PHTIME1. Next, in step SC28, "1" is set into the phrase run flag PHRUN1, while "0" is set into the phrase-on flag PHON1. By this time, a phrase timing wait time has elapsed.

Then, once the phrase run flag PHRUN1 has turned to "1", the determination in step SC29 becomes "YES", which causes the program to move to step SC32. Thereafter, in a similar manner to the above-mentioned reproduction process on the phrase data PDATAn during the real-time performance, reproduction on the phrase data PDATAn is executed for the phrase tracks PT1 to PT4. In this case, when the counter i shows a value of "1", for instance, reproduction for the phrase track PT1 is executed.

Thereafter, the above-mentioned timer interrupt process is repeatedly executed until step SC15 determines that the gate time register GATE1 has reached a value of "0". The gate time register GATE1 at "0" indicates that a timing to terminate the reproduction of the phrase data PDATAn has been reached. In response to this, the determination in step SC16 becomes "YES", which causes the program to proceed to step SC17. In step SC17, the phrase run flag PHRUN1 is set at "0". Because of this, the determination in step SC29 for the corresponding phrase track becomes "NO", so that the reproduction for the phrase track is terminated.

Further, once end data END is read out in step SC4 or SC8, the determination in step SC6 turns to "YES", so that the program goes to step SC13 to set "0" into the song play run flag SRUN1. In response to this, the reproduction from the song playing track is terminated.

CASE 4: Description on a Song Data Reproduction Process (where recording of phrase data PDATAn is involved)

(1) Switch Process

Next, a description will be given below on such a case where the phrase switch PHSW1 or PHSW2 is operated and the operation result is recorded as phrase data PDATAn of the song data shown in FIG. 12. In this case, because the recording switch RC is operated, the program takes steps SB1, SB2 and SB3, and the determination in step SB3 becomes "NO". So, step SB5 sets the recording switch REC at "1". Then, once the start/stop switch ST/SP is operated, the program takes a path through steps SB6, SB7 and SBS. A "YES" determination is obtained in step SB8, causing the program to proceed to step SB12 for writing a tone color, tempo etc. into the header HDR of the song recording track. Subsequently, in step SB13, "0" is set into the song play time register STIME2, "1" is set into the song recording run flag SRUN2, and "0" is set into the recording switch flag REC.

Next, in step SB10, first timing data TIME in the song playing track is read out and set into the song play time register STIME1, and i n step SB11, "1" is set into the song play run flag SRUN1. With these operations, the song playing track is ready for reproduction, while the song recording track is ready for recording. If song data recording is done first, only a recording process is executed because no data is present in the song playing track.

<Process for Phrase Switch PHSW1, PHSW2 >

Then, once the phrase switch PHSW1 or PHSW2 is operated, the determination in step SB18 becomes "YES", which causes the program to proceed to step SB19. Since reproduction from the song playing track is in progress, an affirmative determination is obtained in step SB19, which causes the program to move to step SB24. In step SB24, a determination is made as to whether the song recording flag SRUN2 is at "1". If the determination in step SB24 is in the affirmative, the program goes to step SB25. In this step SB25, if the phrase switch PHSW1 has been operated, "1" is set into the phrase-on flag PHON1, and the stored content in the phrase assignment register PHASIN1 is set into the phrase number register PHNUM1; if the phrase switch PHSW2 has been operated, "1" is set into the phrase-on flag PHON2, and the stored content in the phrase assignment register PHASIN2 is set into the phrase number register PHNUM2.

Then, the program moves on to step SB26, where data in the header PHDR of the phrase data PDATAn indicated by the phrase number register PHNUM1 (or PHNUM2) are read out and provided to the tone source circuit 27 and the like. Subsequently, in step SB27, the gate time register GATE1 (or GATE2) is set at "0".

If the phrase switch PHSW1 or PHSW2 is being depressed, a negative determination is obtained in step SB30, which causes the program to jump to step SB35. In step SB35, the above-mentioned other processing is executed, after which the program returns to the main routine.

(2) Timer Interrupt Process

A description will be given below on the timer interrupt process executed in the above-mentioned process. In this timer interrupt process, the program takes steps SC1, SC2 and SC3, and then it executes operations in step SC4 and following steps each time the song time register STIME1 reaches a value of "0". Thus, in steps SC5 to SC13, at a predetermined timing, note data NOTE is audibly reproduced or sounded, next event data is read out, and timing data TIME is set into the song time register STIME1. From that time on, such a process is repeatedly executed in response to each timer interrupt signal given from the timer 26.

If, on the other hand, the event data is phrase event data PEVT, gate time is set into the gate time register GATE1 or GATE2 in step SC11, and the gate time register GATE1 or GATE2 is decremented in steps SC14 to SC16. After that, the program proceeds to steps SC18, SC23 so as to execute reproduction of phrase data PD starting in step SC23. From that time on, such a process is repeatedly executed in response to each timer interrupt signal given from the timer 26.

If the phrase switch PHSW1 or PHSW2 is operated at this time, "0" is set into the gate time register GATA in step SB27 and thus the determination in step SC14 becomes affirmative, so that step SC 18 is taken even if phrase data has been read out on the basis of the phrase event. Accordingly, even upon arrival of a timing to terminate the phrase having been reproduced till then, the phrase run flag PHRUN1 pr PHRUN2 is not reset to "0" in step SC17, so that the phrase reproduction corresponding to the phrase switch PHSW1 or PHSW2 will not end.

Because in this case the song recording track is in the recording state, the determination in step SC18 becomes "YES", and the program goes to step SC19. Then, the value in the song recording time register STIME2 is decremented, and step SC20 is taken to determine whether any switch event has been detected. Namely, step SB35 determines whether or not a flag has been set for any of the switches relating to the performance. If answered in the affirmative, the program goes to step SC21 to write event data for the switch into the song recording track as well as into the song recording time register STIME2.

If, for instance, the phrase switch PHSW1 has been operated, the stored content in the phrase assignment register PHASIN1, i.e., the phrase number assigned to the phrase switch PHASIN1 is written as new phrase event data PEVT, along with data indicating that there has been an event of the phrase switch PHSW1. Further, if an off-event of the phrase switch PHSW1 has been detected, writing is made of a gate time from a time point when the on-event of the phrase switch PHSW1 was detected to a time point when the off-event of the phrase switch PHSW2 was detected.

If, on the other, an event of the keyboard switch KBS or the like has been detected, on-event, note number, velocity etc. of the switch are written. It should be appreciated that, in the case of a switch whose velocity is undetectable, a constant value, for instance, may be written. Further, if an event of any switch for changing tone color, tempo, tone volume or the like has been detected, data on such an event is written. Then, upon completion of writing of such event data, the corresponding flags are reset. Subsequently, in step SC22, "0"is set into the song recording time register STIME2. Thereafter, in a similar manner to the above-mentioned process, reproduction operations on the phrase data PDATAn starting step SC23 are executed for phrase tracks PT1 to PT4.

(3) Switch-off Process for Phrase Switch PHSW1, PHSW2

If the phrase switch PHSW1 or PHSW2 that has been in the switched-on state is switched off during the above-mentioned process, the determination in step SB30 of the switch process becomes "YES", which causes the program to move to step SB31. If recording into the song recording track is in progress, an affirmative determination is obtained in step SB31 because the song recording flag SRUN2 is at "1", and this determination causes the program to step SB33. In step SB33, it is determined whether the gate time register GATE1 or GATE2 is at "0". This determination is done for checking to see whether any phrase is being reproduced at a time when the phrase switch PHSW1 or PHSW2 has been switched off. In other words, this determination is done for preventing a phrase reproduction from being interrupted in such a case where, after the phrase switch PHSW1 or PHSW2 has been switched on, phrase event PEVT is read out from the song playing track and a phrase based thereon is being reproduced in place of a phrase based on the phrase switch PHSW1 or PHSW2. If the phrase run flag PHRUN1 PHRUN2 is forcefully set at "0" in such a case where any phrase event data PEVT t o be read out from the song playing track is still left when the phrase switch PHSW1 or PHSW2 has been switched off, the phrase reproduction will be put to an end. Therefore, if the gate time register GATE1 or GATE2 at "0", an affirmative determination is obtained in step SB33, the program moves to step SB34 to set the phrase switch PHSW1 or PHSW2 at "0". This terminates the phrase reproduction.

If on the other hand, the gate time register GATE1 or GATE2 is not at "0", it means that phrase data based on the phrase event data PEVT is being reproduced, so that the program moves to step SB35 without setting the phrase run flag PHRUN1 or PHRUN2 at "0" in step SB34. In this case, the phrase reproduction is executed starting in step SC23 of the timer interrupt process, since the phrase run flag PHRUN1 or PHRUN2 does not turn to a value of "0" until the gate time register GATE1 or GATE2 reaches a value of "0".

CASE 5: Description on Song Data Reproduction Process (where only a phrase reproduction by the phrase switch PHSW1 or PHSW2 is involved)

(1) Switsh Process

Next, a description will be given below on such a case where, during a song data reproduction process, the phrase switch PHSW1 or PHSW2 is operated, and only a phrase reproduction is executed without the operation result being recorded as phrase data PDATAn. In this case, negative determinations are obtained in both of steps SB1 and SB6, which causes the program to branches to step SB18. Then, a "YES" determination is obtained in step SB18, which causes the program to proceed to step SB19. Since reproduction from the song playing track is in progress, a "YES" determination is obtained in step SB19, which causes the program to proceed to step SB24. In step SB24, a determination is made as to whether the song recording flag SRUN2 is at "1". If the recording switch RC has not been operated, a "NO" determination is obtained in step SB24, which causes the program to branches to step SB28.

If the phrase switch PHSW1 has been operated, step SB28 sets the phrase-on flag PHON3 at "1" and sets the content in the phrase assignment register PHASIN1 into the phrase number register PHNUM3. Likewise, if the phrase switch PHSW2 has been operated, step SB28 sets the phrase-switch on flag PHON4 "1" and sets the content in the phrase assignment register PHASIN2 into the phrase number register PHNUM4. Next, in step SB29, data in the header PHDR of the phrase data PDATAn indicated by the phrase number register PHNUM3 (or PHNUM4) are read out and provided to the tone source circuit 27 and the like.

(2) Timer interrupt Process

Next, the timer interrupt process for CASE 5 will described below. More specifically, a description will given on such a case where the phrase switch PHSW1 operated while a phrase is reproduced on the basis phrase event data PEVT read out from the song playing track, so as to reproduce phrases in parallel.

<Reproduction Process on Phrase Data PDATAn >

During the reproduction process on phrase data PDATAn starting in step SC23, phrase data PDATAn is reproduced on the basis of phrase event data PEVT read out from the song playing track as long as the value in the counter i is "1", as mentioned earlier.

Further, in this case, because the phrase-on flag PHON3 has been set at "1" in step SB28, the determination in step SC26 becomes "YES" once the counter i has reached a value of "3". Then, in step SC27, first timing data PTM in the phrase data PDATAn indicated by the phrase number register PHNUM3 is read out and set into the phrase time register PHTIME3. Next, in step SC28, the phrase run flag PHRUN3 is set at "1", while the phrase-on flag PHON3 is set at "0"

Because the phrase run flag PHRUN3 is now at "1", a "YES" determination is obtained in step SC29, which directs the program to step SC32. Step SC32 decrements the value in the phrase time register PHTIME3, and next step SC33 determines whether the phrase time register PHTIME3 is at "0" If the phrase time register PHTIME3 has not reached "0", step SC30 is taken; if the phrase time register PHTIME3 has reached "0", step SC34 is taken to read out event data of the phrase data PDATAn indicated by the phrase number register PHNUM3. The phrase data PDATAn read out here is the one assigned to the phrase switch PHSW1. Thereafter, on the basis of the read-out event data, a tone is sounded through the loud speaker in a manner as previously mentioned. During reproduction of this phrase data PDATAn, phrase data PDATAn is reproduced in parallel therewith.

In this case, during reproduction for phrase track PT1, reproduction for phrase track PT3 is simultaneously achieved.

(3) Switch-off Process for Phrase Switch PHSW1, PHSW2

When, on the other hand, the phrase switch PHSW1 or PHSW2 has been switched off, various operations starting in step SB30 are executed in the switch process as mentioned earlier, and thus the phrase reproduction is terminated.

CASE 6: Description on a Stop Process

Next, a description will be given below on a stop process that is executed in response to operation of the start/stop switch ST/SP during reproduction of the song data. In this case, an affirmative determination is obtained in step SB6, and it is determined in step SB7 whether the song play run flag SRUN is at "0". The determination in step SB7 remains negative during reproduction from the song playing track, and the program branches to step SB14. In step SB14, "0" is set into the song play run flag SRUN1 and phrase run flags PHRUN1 and PHRUN2. Next, in step SB15, it is determined whether the song play run flag SRUN2 is at "1". A "NO" determination is obtained in step SB15 if recording into the song recording track is not in progress. Conversely, a "YES" determination is obtained in step SB15 if recording into the song recording track is in progress, and thus the program proceeds to step SB16 to set "0" into the song recording run flag SRUN2. After that, in step SB17, the data recorded into the song recording track is mixed into the song playing track, and timing data TIME is newly imparted thereto, to thereby renew the song playing track.

GENERAL FLOW OF THE OPERATION

Next, actions of the automatic performance device responsive to operations of the switches will be described in connection with the above-mentioned phrase tracks PT1 to PT4.

<Normal Real-time Performance >

Once the player operates any of the keyboard switches KBS after turning-on of the power source, a tone corresponding to the operated keyboard switch KBS is sounded via the loud speaker. Once the phrase switch PHSW1 is operated, phrase data PDATAn assigned to the phrase switch PHSW1 is reproduced from phrase track PT3, and similarly, once the phrase switch PHSW2 is operated, phrase data PDATAn assigned to the phrase switch PHSW2 is reproduced from phrase track PT4.

<Reproduction of Song Data >

Once the player operates the start/stop switch ST/SP, data in the song playing track is reproduced for initiation of an automatic performance. If phrase event data PEVT is prestored in the playing track, phrase data PDATAn indicated by the phrase event data PEVT is reproduced. If this phrase event data PEVT is prestored by operation of the phrase switch PHSW1, phrase data PDATAn read out from the ROM 23 is reproduced via phrase track PT1; if this phrase event data PEVT is prestored by operation of the phrase switch PHSW2, phrase data PDATAn read out from the ROM 23 is reproduced via phrase track PT2.

Further, once the player operates the start/stop switch ST/SP after operating the recording switch RC, recording (overdubbing) of a song is initiated. Once the phrase switch PHSW1 is operated during the recording, phrase data PDATAn assigned to the switch PHSW1 is reproduced via phrase track PT1, and this event is recorded into the phrase recording track as phrase event data PEVT. If, at this time, phrase data PDATAn is being reproduced via phrase track PT1 on the basis of phrase event data PEVT in the song playing track, the phrase data being reproduced is interrupted so that the phrase data PDATAn newly designated by the operation of the phrase switch PHSW1 is reproduced via phrase track PT1, and the phrase event data PEVT is recorded into the song recording switch. The newly recorded phrase event data PEVT is mixed into the song playing track upon termination of the operation.

In addition, once the player operates the phrase switch PHSW2 during the reproduction of the phrase data PDATAn, phrase data assigned to the switch PHSW2 is read out and recorded into phrase track PT2. Then, data in the phrase tracks PT1 and PT2 are simultaneously reproduced, and such a reproduction is recorded into the song recording track.

Further, the player's operation of the phrase switch PHSW1 during reproduction from the song playing track (in the non-recording state), phrase data PDATAn assigned to the phrase switch PHSW1 is reproduced via phrase track PT3. Thus, data in phrase tracks PT1 and PT3 are simultaneously reproduced, so that two phrases are reproduced in parallel.

According to the principle of the present invention, the automatic performance for recording phrase data is not be limited to that of song data having melody etc. recorded therein, but it may also be recorded among automatic performance data relating to chord, chord progression or rhythm. Further, the storage format is not be limited to the (on-event+gate time) format as in the above-described embodiment but may also be any other format such as (on-event+ timing) or (off-event+timing.

Moreover, the phrase data are not limited to those prestored in the ROM 23 but may be those prepared by the player as desired. Further, the phrase data have all been described as having a data length to cover only one measure, but alternatively, phrases of different data length may be used. Further, the phrase data may be modified in their tone pitch by separately designated chord.

Moreover, although the above-described embodiment is arranged in such manner that a phrase is reproduced from a time point when the phrase switch PHSW1 or PHSW2 is turned on to a time point when the same switch is turned off, alternative arrangement may be such that a phrase is reproduced to its end by turning-on of the switch PHSW1 or PHSW2, and that an off-event of the switch PHSW1 has noting to do with a phrase reproduction operation.

Moreover, data may be exchanged between an external automatic performance device and a phrase performance device. Namely, the alternative arrangement may be such that the phrase performance device supplies the external automatic performance device with operating member operation data plus phrase assignment data to in MIDI (Musical Instrument Digital Interface) format, so that the external automatic performance device stores these data and then the external automatic performance device reproduces the stored data and supplies the data to the phrase performance data so as to execute automatic performance plus phrase performance.

In accordance with the present invention as has been described so far, in response to operation of an operating member to which is assigned first automatic performance data, the first automatic performance data assigned to the operating member is recorded between the second automatic performance data along with data indicative of the operation of the operating member. This allows the first automatic performance data to be recorded between the second automatic performance data as desired, and it is possible to automatically reproduce the first automatic performance data along with the second automatic performance data. Accordingly, the first automatic performance data can be reproduced adlib. Further, instruction data which instructs performance of any of the first automatic performance data is recorded between the second automatic performance data in such a manner that, during reproduction of the second automatic performance data, the first automatic performance data is read out on the basis of the instruction data and also the first automatic performance data assigned to the operating member is read out in response to operation of the operating member. Therefore, in addition to performance based on the second automatic performance data, the first automatic performance data can be reproduced by the player's operation of the operating member. This achieves performance full of variety.

What is claimed is:

1. An automatic performance device comprising:

first means for executing a first automatic performance;

second means for executing a second automatic performance;

instruction means for generating an instruction instructing execution of the second automatic performance during said first automatic performance;

timing setting means for setting a predetermined timing at which the second automatic performance is to start during the first automatic performance, said predetermined timing being a first performance timing of said first automatic performance; and performance control means, responsive to said instruction given by said instruction means during the first automatic performance, for causing said second execution means to execute the second automatic performance at said predetermined timing.

2. An automatic performance device as defined in claim 1 wherein said timing is indicative of a predetermined beat in the first automatic performance.

3. An automatic performance device as defined in claim 1 wherein said second means comprises storage means for storing plural kinds of automatic performance data and reproduction means for reproducing the automatic performance data stored in said storage means, and wherein said timing setting means sets said timing for each kind of the automatic performance data independently of other kind.

4. An automatic performance device as defined in claim wherein, if the instruction is given by said instruction means when the first automatic performance is not being executed, said performance control means causes the second automatic performance to immediately start irrespective of said timing set by said setting means.

5. An automatic performance device as defined in claim 1 wherein said performance control means causes the second automatic performance to stop when the instruction given by said instruction means is cancelled.

6. An automatic performance device as defined in claim 1 wherein said performance control means causes the second automatic performance to be repeatedly executed until the instruction given by said instruction means is cancelled.

7. An automatic performance device comprising:

first storage means comprising read/write storage for storing first automatic performance data;

second storage means storing a plurality of second automatic performance data;

operator means including an operator to which is assigned identification data identifying respective ones of the second automatic performance data;

recording control means for, in response to operation of said operator, recording into said first storage means operation data indicative of the operation of said operator and the identification data assigned to said operator as a part of said first automatic performance data;

read-out control means for reading out the first automatic performance data from said first storage means and for, if the operation data and the identification data are contained in the read-out first automatic performance data, reading out from said second storage means the second automatic performance data corresponding to the identification data; and tone generating means for generating a tone signal on the basis of the first and second automatic performance read out by said read-out control means.

8. An automatic performance device as defined in claim 7 wherein said operator means includes a plurality of said operators, and said recording control means performs control to record operator identification data identifying any of said operators as a part of the operation data.

9. An automatic performance device as defined in claim 7 wherein, when the operation data and operator identification data in the first automatic performance data are read out, said read-out control means reads out the second automatic performance data corresponding to the operator identification data after waiting for a predetermined beat timing to be reached.

10. An automatic performance device as defined in claim 7 wherein said operation data contains time data that is indicative of a time from start to end of operation of said operator.

11. An automatic performance device as defined in claim 10 wherein said read-out control means repetitively reads out the second automatic performance data for the time indicated by the time data.

12. An automatic performance device comprising:

first storage means storing first automatic performance data, said first automatic performance data including instruction data;

second storage means for storing a plurality of second automatic performance data, said instruction data instructing performance of any of said second automatic performance data;

operator means including an operator to which is assigned at least one of said second automatic performance data;

first read-out control means for reading out the first automatic performance data;

second read-out control means for reading out, from said second storage means, the second automatic performance data instructed by said instruction data in the first automatic performance data read out by said first read-out control means, and the second automatic performance data that is assigned to said operator in response to operation of said operator; and tone generating means for generating a tone signal on the basis of the first and second automatic performance data read out by said first and second read-out control means.

13. An automatic performance device as defined in claim 12 wherein, when the instruction data in the first automatic performance data is read out, said second read-out control means reads out the second automatic performance data corresponding to the instruction data after waiting for a predetermined beat timing to be reached.

14. An automatic performance device as defined in claim 12 wherein, when said operator is operated, said second read-out control means reads out the second automatic performance assigned to said operator after waiting for a predetermined beat timing to be reached.

15. An automatic performance device as defined in claim 12 wherein said instruction data contains time data indicative of a time from start to end of the second automatic performance.

16. An automatic performance device as defined in claim 15 wherein said second read-out control means repetitively reads out the second automatic performance data for the time indicated by the time data.

17. An automatic performance device comprising:

first storage means for storing first performance data;

second storage means for storing second performance data;

first performance means for executing a first automatic performance based on the first performance data;

second performance means for executing a second automatic performance during the first performance based upon the second performance data; and delay means for initiating the second automatic performance in delayed synchronization with the first automatic performance.

18. The automatic performance device of claim 17, wherein the delay means further comprises:

instruction means for instructing the automatic performance device to initiate the second automatic performance during the first automatic performance;

timing setting means for setting a start timing for the second automatic performance based upon the first performance data; and control means for initiating the second automatic performance at the start timing.

* * * * *